US010472927B2

(12) United States Patent
Marcin et al.

(10) Patent No.: US 10,472,927 B2
(45) Date of Patent: Nov. 12, 2019

(54) DOWNHOLE DROP PLUGS, DOWNHOLE VALVES, FRAC TOOLS, AND RELATED METHODS OF USE

(71) Applicant: VANGUARD COMPLETIONS LTD., Edmonton (CA)

(72) Inventors: Jozeph Robert Marcin, Spruce Grove (CA); Branko Calic, Edmonton (CA)

(73) Assignee: Vanguard Completions Ltd., Edmonton, Alberta (CA)

( * ) Notice: Subject to any disclaimer, the term of this patent is extended or adjusted under 35 U.S.C. 154(b) by 275 days.

(21) Appl. No.: 15/352,399

(22) Filed: Nov. 15, 2016

(65) Prior Publication Data

US 2017/0175487 A1 Jun. 22, 2017

(51) Int. Cl.

| | |
|---|---|
| ***E21B 43/26*** | (2006.01) |
| ***E21B 34/14*** | (2006.01) |
| ***E21B 34/10*** | (2006.01) |
| ***E21B 33/12*** | (2006.01) |
| *E21B 34/00* | (2006.01) |

(52) U.S. Cl.

CPC ..... *E21B 34/10* (2013.01); *E21B 33/12* (2013.01); *E21B 43/26* (2013.01); *E21B 2034/007* (2013.01)

(58) Field of Classification Search

CPC .... E21B 43/26; E21B 34/14; E21B 2034/007; E21B 34/063

See application file for complete search history.

(56) References Cited

U.S. PATENT DOCUMENTS

| | | | |
|---|---|---|---|
| 2,177,928 | A | 10/1939 | Knudsen |
| 2,754,910 | A | 7/1956 | Derrick et al. |
| 2,933,136 | A | 4/1960 | Ayers et al. |
| 3,599,307 | A | 8/1971 | Campbell et al. |
| 3,772,750 | A | 11/1973 | Hauser |
| 4,102,401 | A | 7/1978 | Erbstoesser |
| 4,244,425 | A | 1/1981 | Erbstoesser |
| 4,410,387 | A | 10/1983 | Halkerston et al. |
| 4,505,334 | A | 3/1985 | Doner et al. |
| 5,375,662 | A | 12/1994 | Echols, III et al. |

(Continued)

FOREIGN PATENT DOCUMENTS

| | | |
|---|---|---|
| CA | 2400132 | 8/2001 |
| CA | 2559111 | 5/2007 |

(Continued)

OTHER PUBLICATIONS

FracPoint Ball-activated Multistage Fracturing Systems—Baker Hughes, URL=https://www.bakerhughes.com/products-and-services/completions/well-completions/multistage-hydraulic-fracturing/fracpoint-multistage-fracturing-system, accessed on Aug. 26, 2015, 1 page.

(Continued)

*Primary Examiner* — Catherine Loikith

(74) *Attorney, Agent, or Firm* — Robert A. Nissen

(57) ABSTRACT

Downhole drop plugs, frac sleeves, and downhole plug-operated valves. The drop plugs may incorporate a ring part and a rod part. The valves may incorporate a bypass to accommodate material that gets stuck in the valve on flowback. The valves may incorporate a compound seat that passes a first ball of a first size and seats a second ball of the first size. Locking seats, dissolvable balls, and dissolvable mandrels are illustrated and discussed as well.

16 Claims, 19 Drawing Sheets

(56) References Cited

U.S. PATENT DOCUMENTS

| | | | | |
|---|---|---|---|---|
| 5,485,882 | A | 1/1996 | Bailey et al. | |
| 5,941,309 | A | 8/1999 | Appleton | |
| 6,318,470 | B1 | 11/2001 | Chang et al. | |
| 7,021,389 | B2 | 4/2006 | Bishop et al. | |
| 7,726,406 | B2 * | 6/2010 | Xu | E21B 23/00 166/317 |
| 8,231,947 | B2 | 7/2012 | Vaidya et al. | |
| 8,291,988 | B2 | 10/2012 | King | |
| 8,316,951 | B2 | 11/2012 | Fay et al. | |
| 8,327,931 | B2 | 12/2012 | Agrawal et al. | |
| 8,397,823 | B2 | 3/2013 | Xu | |
| 8,413,727 | B2 | 4/2013 | Holmes | |
| 8,430,173 | B2 | 4/2013 | Todd et al. | |
| 8,528,633 | B2 | 9/2013 | Agrawal et al. | |
| 8,646,531 | B2 | 2/2014 | King et al. | |
| 8,662,162 | B2 | 3/2014 | Kellner et al. | |
| 8,770,299 | B2 | 7/2014 | King | |
| 8,851,172 | B1 | 10/2014 | Dudzinski | |
| 8,905,147 | B2 | 12/2014 | Fripp et al. | |
| 9,010,416 | B2 | 4/2015 | Xu et al. | |
| 9,033,060 | B2 | 5/2015 | Xu et al. | |
| 9,057,242 | B2 | 6/2015 | Mazyar et al. | |
| 9,080,403 | B2 | 7/2015 | Xu et al. | |
| 9,085,968 | B2 | 7/2015 | Xu et al. | |
| 9,267,347 | B2 | 2/2016 | Agrawal et al. | |
| 2004/0163820 | A1 | 8/2004 | Bishop et al. | |
| 2007/0107908 | A1 | 5/2007 | Vaidya et al. | |
| 2009/0056952 | A1 | 3/2009 | Churchill | |
| 2010/0270031 | A1 | 10/2010 | Patel | |
| 2011/0030968 | A1 | 2/2011 | Xu | |
| 2011/0030976 | A1 | 2/2011 | King | |
| 2011/0073320 | A1 | 3/2011 | Fay et al. | |
| 2011/0100647 | A1 | 5/2011 | King et al. | |
| 2011/0132612 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2012/0006562 | A1 | 1/2012 | Speer et al. | |
| 2012/0073819 | A1 * | 3/2012 | Richard | E21B 33/10 166/308.1 |
| 2012/0073827 | A1 | 3/2012 | Kenyon et al. | |
| 2012/0118583 | A1 | 5/2012 | Johnson et al. | |
| 2012/0234538 | A1 | 9/2012 | Martin et al. | |
| 2012/0266994 | A1 | 10/2012 | King | |
| 2013/0032357 | A1 | 2/2013 | Mazyar et al. | |
| 2013/0068461 | A1 | 3/2013 | Maerz et al. | |
| 2013/0140030 | A1 | 6/2013 | Rankin | |
| 2013/0186616 | A1 | 7/2013 | Xu et al. | |
| 2013/0186647 | A1 | 7/2013 | Xu et al. | |
| 2013/0186649 | A1 | 7/2013 | Xu et al. | |
| 2014/0158368 | A1 | 6/2014 | Hofman et al. | |
| 2014/0158378 | A1 | 6/2014 | Ku et al. | |
| 2014/0318816 | A1 | 10/2014 | Hofman et al. | |
| 2015/0159462 | A1 | 6/2015 | Cutler | |
| 2015/0184485 | A1 | 7/2015 | Xu et al. | |
| 2015/0260019 | A1 | 9/2015 | Xu et al. | |

FOREIGN PATENT DOCUMENTS

| | | |
|---|---|---|
| CA | 2770064 | 2/2011 |
| CA | 2778124 | 5/2011 |
| CA | 2783113 | 6/2011 |
| CA | 2804868 | 1/2012 |
| CA | 2804871 | 1/2012 |
| CA | 2833405 | 10/2012 |
| CA | 2841926 | 2/2013 |
| CA | 2861818 | 8/2013 |
| CA | 2861820 | 8/2013 |
| CA | 2752864 | 4/2014 |
| CA | 2846751 | 9/2014 |
| CA | 2770061 | 10/2014 |
| EP | 2739812 | 6/2014 |
| WO | 2013022635 | 2/2013 |
| WO | 2014088736 | 6/2014 |
| WO | 2014099210 | 6/2014 |
| WO | 2014138653 | 9/2014 |
| WO | 2015026367 | 2/2015 |
| WO | 2015069982 | 5/2015 |

OTHER PUBLICATIONS

Glass Epoxy NEMA Grade G-10 Data Sheet, URL =http://www.polymerplastics.com/images/dataSheets/DSG-10.pdf, accessed on Nov. 6, 2015, 1 page.

Spherical Ring—Wolfram MathWorld, URL =http://mathworld.wolfram.com/SphericalRing.html, accessed on Nov. 10, 2015, 2 pages.

* cited by examiner

DOWNHOLE DROP PLUGS, DOWNHOLE VALVES, FRAC TOOLS, AND RELATED METHODS OF USE

TECHNICAL FIELD

This document relates to downhole drop plugs, balls, frac tools and sleeves, and methods of use related to the foregoing.

BACKGROUND

Downhole valves are used in the hydraulic fracturing of subterranean oil and gas formations to isolate and pressurize segments of the wellbore. Such valves are often closed by seating a plug or ball, dropped from surface, within the downhole valve to restrict fluid flow through the valve. Frac plugs are known having an outer metal shell and hollow core, which may comprise a degradable substance. Tubular actuators exist that have a slide configured to seat a first same plug in a first position and a second same plug in a second position. Devices exist for re-directing fluid flow from the interior of tubing placed in a well to the exterior of the tubing, such devices having a bypass to the exterior of the tubing for the flow of fluids around obstructions in the tubing. Valves are known to have a tapered inward facing surface that squeezes a sleeve inwardly to create an upper seat for the drop ball.

SUMMARY

A downhole drop plug is disclosed comprising: a ring part defining an interior bore and being made of one of a first or second structural material; and a rod part nested within the interior bore of the ring part and being made of the other of the first and second structural material.

A combination is also disclosed comprising a downhole valve tool seating a downhole drop plug. A method is disclosed comprising seating a downhole drop plug on a seat within a downhole valve tool.

A downhole drop plug may comprise a rod part made of a non-metal composite material, such as a glass fiber epoxy material, and inserted within a metal ring part.

A downhole drop plug is disclosed composed of a glass or carbon fiber epoxy part and a metal part, with a suitable shape, including a ball or plug shape.

A downhole drop plug is disclosed comprising a spherical ring with a cylinder inserted between axial end openings defined by the ring, the cylinder having spherical end caps.

A method of making a downhole drop plug comprising inserting a rod part into a ring part.

A frac ball having a cylindrical rod made of a first material and positioned within a ring made of a second material, in which the rod and ring collectively form the shape of a ball, in which one of the first and second materials is a low density non-metal, and the other of the two materials is a high strength metal such as aluminum.

Further features increase the chance of patentability, for example structuring the shape of the metal component such that in all possible orientations the metal component contacts the seat, reciting specific ranges of rod radii, specific ranges of density for the low density component, the use of laminated layers of carbon fiber as the low density material, the orientation of the composite layers relative to the shape of the metal component, and the embodiment where the rod core is metal.

A downhole valve is disclosed comprising: an outer housing defining an interior bore; an inner mandrel mounted in the interior bore, the inner mandrel defining an interior passageway between an uphole end and a downhole end of the inner mandrel, the inner mandrel defining an uphole facing drop plug seat surface encircling the interior passageway; the uphole facing drop plug seat being sized to receive a drop plug to close the downhole valve; and the downhole valve being structured to expose a bypass across the inner mandrel at least upon receipt of, and application of fluid pressure in an uphole direction against, an object on a downhole facing restriction surface defined within the interior bore, the bypass located within the interior bore.

A downhole valve is disclosed comprising: an outer housing defining an interior bore; an inner mandrel mounted in the interior bore, the inner mandrel defining an interior passageway between an uphole end and a downhole end of the inner mandrel; and the inner mandrel having a first position where the inner mandrel is actuatable by a drop plug to shift to a second position to form a downhole facing stop surface that locks the drop plug between the downhole facing stop surface and an uphole facing drop plug seat surface of the downhole valve.

A method is disclosed comprising pumping a drop plug down a well into an interior bore of a downhole valve to actuate the downhole valve to form a downhole facing stop surface that locks the drop plug between the downhole facing drop plug stop surface and an uphole facing drop plug seat surface.

A downhole drop plug is also disclosed comprising: a first part, such as a core comprising a first metal that dissolves in the presence of an electrolyte; and a second part, such as an outer metal shell, that is in electrical contact with the first metal, and that accelerates the rate of dissolution of the first metal when the first metal and the second metal are exposed to the electrolyte.

A method is disclosed comprising seating the downhole drop plug on a seat within a downhole valve tool.

A downhole valve is disclosed comprising: an outer housing defining an interior bore; an inner mandrel mounted in the interior bore, the inner mandrel defining an interior passageway between an uphole end and a downhole end of the inner mandrel, the inner mandrel defining an uphole facing drop plug seat surface encircling the interior passageway; and in which the inner mandrel comprises dissolvable material.

A method is disclosed comprising: pumping a drop plug down a well into an interior bore of a downhole valve to close the downhole valve; and degrading a dissolvable portion of the downhole valve by exposing the dissolvable portion to wellbore fluids or fluids within the interior bore.

A fracturing sleeve is disclosed.

A method is disclosed comprising: pumping a first drop plug down a well through, and out a downhole end of, an interior bore of a downhole valve; pumping a second drop plug down the well to seat the second drop plug on an uphole facing drop plug seat surface to close the downhole valve; and permitting reverse flow in the well to unseat the second drop plug and lodge the first drop plug or a downhole object on a downhole facing restriction surface in the downhole valve, in which during reverse flow fluid travels across the downhole valve through a bypass located within the interior bore of the downhole valve.

A downhole valve is disclosed comprising: an outer housing defining an interior bore; an inner mandrel mounted in the interior bore, the inner mandrel defining an interior passageway between an uphole end and a downhole end of the inner mandrel; the inner mandrel having a first position where the inner mandrel is actuatable by a first drop plug to pass the first drop plug downhole and shift to a second position to form an uphole facing drop plug seat surface that encircles the interior passageway and is sized to receive a second drop plug that has the same dimensions as the first drop plug.

A method is disclosed comprising: pumping a first drop plug down a well to pass into, and out a downhole end of, an interior bore of a downhole valve to actuate the downhole valve to form an uphole facing drop plug seat surface; and pumping a second drop plug down the well to seat the second drop plug on the uphole facing drop plug seat surface to close the downhole valve, the second drop plug having the same dimensions as the first drop plug.

In various embodiments, there may be included any one or more of the following features: The first structural material comprises a pure metal or alloy and the second structural material comprises a non-metal. The ring part comprises the first structural material. External surfaces of both the ring part and the rod part collectively form a sphere. The ring part defines first and second open axial ends spanned by first and second axial end surfaces, respectively, of the rod part. The ring part has a minimum radial distance, between the first and second open axial ends, of between 60 and 120 degrees. The ring part has a minimum radial distance between the first and second open axial ends of between 80 and 100 degrees. The ring part forms a spherical ring and the rod part forms a cylinder with opposed spherical caps, which define the first and second axial end surfaces, respectively. The ring part forms a ring of a spherical shell, and the ring part fits within a corresponding groove in the rod part. The rod part comprises first and second rod parts separated by an internal wall across the interior bore of the ring part. The interior bore of the ring part extends continuously between the first and second open axial ends. The rod part is made of the second structural material, which comprises a composite of a matrix of plural layers of woven material laminated in a solid adhesive polymer, in which the plural layers run along an axis defined by the interior bore of the ring part. A center of gravity of the sphere is located at the center of the sphere. The sphere defines a plane of symmetry across a center of the sphere. The ring part and the rod part are dimensioned such that the first structural material accounts for a coverage of between 30-70% of an external seating surface area of the sphere in a seating orientation that represents a minimum coverage by the first structural material. The ring part and the rod part are dimensioned such that the first structural material forms the ring part and accounts for a coverage of 50% of the external seating surface area of the sphere in the seating orientation that represents the minimum coverage by the first structural material. The rod part is fixed against axial movement within the interior bore of the ring part by a threaded connection, an adhesive, a press fit, a weld, an in-ring casting, injection molding, or combinations of the preceding mechanisms. The second structural material has a density below 2 g/cm3, and the first structural material has a density above 2.5 g/cm3. The first structural material has a density above 5 g/cm3. The first structural material has a higher yield strength than the second structural material. The first structural material has a yield strength of at least 1.5 times the yield strength of the second structural material. The second structural material comprises a composite of a matrix of woven or particulate material encased in a solid adhesive polymer. The matrix comprises carbon or glass fiber. The first structural material comprises a first metal that dissolves in the presence of an electrolyte and the second structural material comprises a second metal that is in electrical contact with the first metal, and that accelerates the rate of dissolution of the first metal when the first metal and second metal are exposed to the electrolyte. A combination comprising a downhole valve tool seating the downhole drop plug. Seating the downhole drop plug on a seat within a downhole valve tool. During use the bypass has a minimum cross-sectional flow area that is equal to 0.3 or more times a minimum cross-sectional flow area of the interior passageway of the inner mandrel. During use the bypass has a minimum cross-sectional flow area that is equal to one or more times the minimum cross-sectional flow area of the interior passageway of the inner mandrel. The bypass is defined in part or in whole by a flow path, such as a plurality of flow paths, communicating between an uphole end and a downhole end of the downhole facing restriction surface. The plurality of flow paths comprise a plurality of grooves in the downhole facing restriction surface. The inner mandrel comprises a sleeve part, and the downhole facing restriction surface is located on the sleeve part and encircles the interior passageway. The downhole facing restriction surface connects to, and is located in a downhole direction relative to, a restriction part of the interior passageway, the restriction part forming a close tolerance fit with a drop plug of a maximum size capable of passing through the downhole valve in a downhole direction. The inner mandrel comprises a stem part mounted to slide axially within a receptacle, defined within the interior bore, between a seated position against an uphole facing stop surface and an unseated position where the bypass is exposed. The stem part is a cylindrical stem whose interior wall defines part of the interior passageway of the inner mandrel. The stem part is coaxial with the outer housing. The receptacle is located on a collar part that has an uphole facing surface that extends radially inward from an inner bore surface of the outer housing, the uphole facing surface encircling an uphole end of the receptacle, and the inner mandrel further comprises a centralizer flange that extends radially outward from an uphole end of the stem part toward the inner bore surface, with an axial passage in the centralizer flange defining part or all of the bypass. The centralizer flange comprises a plurality of fins that are spaced from one another to define a plurality of the axial passages in the centralizer flange. A downhole facing stop surface is located in the interior bore in an uphole direction from the receptacle for contacting and restricting uphole travel of the centralizer flange. The collar part is a sleeve part threaded to the inner bore surface of the outer housing. A rotational lock between the stem part and the outer housing. The inner mandrel has a first position where the inner mandrel is actuatable by a first drop plug to pass the first drop plug downhole and shift to a second position to form the uphole facing drop plug seat surface, which is sized to receive a second drop plug, which has the same dimensions as the first drop plug, to close the downhole valve. A fracturing sleeve. When the downhole valve is closed by the second drop plug; pressurizing fluid in the well to an extent sufficient to open a port to an exterior of the downhole valve; and pumping fluid through the port into the exterior of the downhole valve at or above a fracturing pressure of the formation. When the downhole valve is closed, a cylindrical stem part of the inner mandrel is seated against an uphole facing stop surface; and when the first drop plug or a downhole object is lodged on the downhole facing restriction surface under reverse flow, the cylindrical stem part unseats to expose a bypass, across the downhole valve, that is defined between an outer wall of the cylindrical stem part and an inner wall of the interior bore. The inner mandrel further comprises a sleeve part mounted to shift along an axis of the interior bore; when the inner mandrel is in the first position, the sleeve part forms an uphole facing actuator surface that is positioned to receive the first drop plug; and when the inner mandrel is in the second position, the sleeve part forms the uphole facing drop plug seat surface. The downhole valve comprises: a first deflector part that pushes the sleeve part radially outward to defeat the uphole facing actuator surface to pass the first drop plug; and a second deflector part that pushes the sleeve part radially inward to form the uphole facing drop plug surface. The first deflector part is structured to contact, during actuation, a downhole facing surface of the sleeve part to push the sleeve part radially outward. The first deflector part comprises a ring. The uphole facing actuator surface is a first uphole facing drop plug seat surface that encircles the interior passageway and is sized to receive the first drop plug. When the inner mandrel is in the first position, the first deflector part stands in the path of the downhole facing surface of the sleeve part, and one or both the first deflector part or a downhole portion of an outer wall of the sleeve part are sloped to cooperate to push the sleeve part radially outward when the inner mandrel is moving from the first position to the second position. The first deflector part is sloped radially outward with increasing distance from the downhole portion of the outer wall of the sleeve part The downhole facing surface of the sleeve part is sloped radially inward with increasing distance from the first deflector part. When the inner mandrel is in the first position, the second deflector part stands in the path of an uphole portion of an outer wall of the sleeve part, and one or both the second deflector part or the uphole portion of the sleeve are sloped to cooperate to push the sleeve part radially inward when the inner mandrel is moving from the first position to the second position. The second deflector part is sloped radially inward with increasing distance from the uphole portion of the outer wall of the sleeve part. The uphole portion is sloped radially inward with decreasing distance from the second deflector part. The second deflector part comprises a cylindrical inner wall that encircles the outer wall of the sleeve part, and the second deflector part narrows radially inward to the cylindrical inner wall in the downhole direction, and the outer wall of the sleeve part conforms to the shape of the cylindrical inner wall along an axial direction when the inner mandrel is in the second position. The uphole facing drop plug seat surface is defined on or adjacent a free uphole end of the sleeve. The inner mandrel or outer housing form an uphole facing stop surface that contacts a downhole facing surface of the sleeve when the inner mandrel is in the second position. The downhole valve is structured to expose a bypass across the inner mandrel at least upon receipt of, and application of fluid pressure in an uphole direction against, an object on a downhole facing restriction surface defined within the interior bore. The inner mandrel comprises a cylindrical stem part mounted to slide axially within a receptacle, defined within the interior bore, between a seated position against an uphole facing stop surface and an unseated position where the bypass across is exposed. The bypass is defined in part or in whole by a plurality of grooves in the downhole facing restriction surface between an uphole end and a downhole end of the downhole facing restriction surface. When the downhole valve is closed by the second drop plug; pressurizing fluid in the well to an extent sufficient to open a port to an exterior of the downhole valve; and pumping fluid through the port into the exterior of the downhole valve at or above a fracturing pressure of the formation. The downhole valve comprises a sleeve part in the interior bore, and during actuation: a first deflector part pushes a downhole facing surface of the sleeve part radially outward to defeat an uphole facing actuator surface to pass the first drop plug; and a second deflector part pushes the sleeve part radially inward to form the uphole facing drop plug seat surface. The inner mandrel comprises a sleeve part mounted to shift along an axis of the interior bore. The inner mandrel is in the first position, the sleeve part forms an uphole facing actuator surface that is positioned to receive the drop plug. The uphole facing actuator surface is also the uphole facing drop plug seat. The downhole valve comprises a first deflector part that pushes the sleeve part radially outward to defeat the uphole facing actuator surface, in which the uphole facing drop plug seat surface is located, at least in the first position, in a downhole direction from the first deflector part. The first deflector part is structured to contact, during actuation, a downhole facing surface of the sleeve part to push the sleeve part radially outward. The first deflector part comprises a ring; and the uphole facing actuator surface encircles the interior passageway and is sized to receive the drop plug. When the inner mandrel is in the first position, the first deflector part stands in the path of the downhole facing surface of the sleeve part, and one or both the first deflector part or a downhole portion of an outer wall of the sleeve part are sloped to cooperate to push the sleeve part radially outward when the inner mandrel is moving from the first position to the second position. The first deflector part is sloped radially outward with increasing distance from the downhole portion of the outer wall of the sleeve part, and the downhole facing surface of the sleeve part is sloped radially inward with increasing distance from the first deflector part. When the inner mandrel is in the second position, the sleeve part forms the downhole facing drop plug stop surface. A second deflector part that pushes the sleeve part radially inward to form the downhole facing drop plug stop surface. When the inner mandrel is in the first position, the second deflector part stands in the path of an uphole portion of an outer wall of the sleeve part, and one or both the second deflector part or the uphole portion of the sleeve part are sloped to cooperate to push the sleeve part radially inward when the inner mandrel is moving from the first position to the second position. The second deflector part is sloped radially inward with increasing distance from the uphole portion of the outer wall of the sleeve part, and the uphole portion is sloped radially inward with decreasing distance from the second deflector part. The second deflector part comprises a cylindrical inner wall that encircles the outer wall of the sleeve part, and the second deflector part narrows radially inward to the cylindrical inner wall in the downhole direction, and the outer wall of the sleeve part conforms to the shape of the cylindrical inner wall along an axial direction when the inner mandrel is in the second position. The downhole facing drop plug stop surface is defined on or adjacent a free uphole end of the sleeve part. A locking part that restricts the inner mandrel from moving from the second position back to the first position. The locking part comprises one or more of a ratchet or an expanding or contracting full or split ring. When the downhole valve is closed by the drop plug; pressurizing fluid in the well to an extent sufficient to open a port to an exterior of the downhole valve; and pumping fluid through the port into the exterior of the downhole valve at or above a fracturing pressure of the formation. The downhole valve comprises a sleeve part in the interior bore. During actuation a first deflector part pushes a downhole facing surface of the sleeve part radially outward to defeat an uphole facing actuator surface. During actuation a second deflector part pushes the sleeve part radially inward to form the downhole facing stop surface. The downhole facing drop plug stop surface is defined on or adjacent a free uphole end of the sleeve part. The second metal has a lower anodic index than the first metal. The difference in anodic index is greater than 0.15 volts. The second part comprises an outer metal part and the first part comprises a core. The outer metal part forms a shell that is impermeable and fully encloses the core. The first metal is exposed to an exterior of the second part. The second part defines openings that expose the core to the exterior and that are too small to see with a naked unaided eye. The second metal is electroplated to the first part, such as the core. The second part has a thickness of 0.0050" or less. The second part has a thickness of 0.0010" or less. The second part has a thickness of 0.0005" or less. The second metal comprises one or more of copper, silver, nickel. The second part comprises a non-metallic coating, such as a polymeric compound, for example polytetrafluoroethylene (PTFE). The first metal comprises magnesium. The first metal is made of pure magnesium or magnesium alloy. A fluid passageway extends into the first metal from an outer surface of the first part. The second metal comprises a conductive sleeve that lines the fluid passageway and is in electrical contact with the first metal. The first part forms a shell. The shell defines a hollow internal portion of the first part, and the fluid passageway extends through the shell into the hollow internal portion. The first part is a solid core. The plug is structured to seat on a downhole valve, in which the second part is structured to expose the first metal upon one or more of: contacting the downhole valve; pressuring up while seated on the downhole valve; or exposure to abrasive proppant materials while seated on the downhole valve. The second metal is not dissolvable in the presence of an electrolyte. An external surface of the downhole drop plug forms a sphere. The second part forms an outer metal shell. Seating the downhole drop plug on a seat within a downhole valve tool. Forming the second part on the downhole drop plug by electroless plating. Damaging the second part to expose the first metal to an exterior of the second part. Damaging the second part by one or more of: creating contact between the downhole drop plug and a downhole valve; applying pressure against the downhole drop plug while seated on the downhole valve; or exposing the downhole drop plug to abrasive proppant materials while seated on the downhole valve. Pumping brine or acid into contact with the second metal and the first metal to dissolve the first metal. The inner mandrel comprises a protective coating covering the dissolvable material. The protective coating is removable on exposure to contact with a downhole drop plug or contact with an abrasive. The uphole facing drop plug seat surface is formed with an abrasion and contact resistant material. The abrasion and contact resistant material comprises steel. The abrasion and contact resistant material is present as a liner positioned within the interior passageway. The dissolvable material comprises a first metal that dissolves in the presence of an electrolyte; and the protective coating comprises a second metal that is in electrical contact with the dissolvable material, and that accelerates the rate of dissolution of the dissolvable material when the dissolvable material and protective coating are exposed to the electrolyte. The protective coating is electroplated to the dissolvable material. The protective coating comprises copper, nickel, or silver. The protective coating comprises a non-metal. The non-metal comprises a polymeric material, such as a thermal or thermo plastic. The polymeric material comprises polytetrafluoroethylene (PTFE). The inner mandrel has a first position where the inner mandrel is actuatable by a drop plug to shift to a second position where the dissolvable material becomes exposed to one or more of wellbore fluids and fluids within the interior passageway. In the first position, an outer wall surface portion of the inner mandrel is sealed within an inner restriction surface in the outer housing, and the dissolvable material is located on or in fluid communication with the outer wall surface portion; and upon actuation the outer wall surface portion slides out of contact with the restriction surface to expose the dissolvable material. The dissolvable material is in fluid communication with the outer wall surface portion via a port in the outer wall surface portion. The downhole valve is actuatable to open a port to an exterior surface of the outer housing. When the downhole valve is closed by the drop plug; pressurizing fluid in the well to an extent sufficient to open a port to an exterior of the downhole valve; and pumping fluid through the port into the exterior of the downhole valve at or above a fracturing pressure of the formation. The downhole valve has a protective coating cover the dissolvable material. Pumping an abrasive into contact with the downhole valve to remove the protective coating. The abrasive is pumped prior to pumping the drop plug down the well. Forming the downhole valve by electroplating the protective coating over the dissolvable material.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
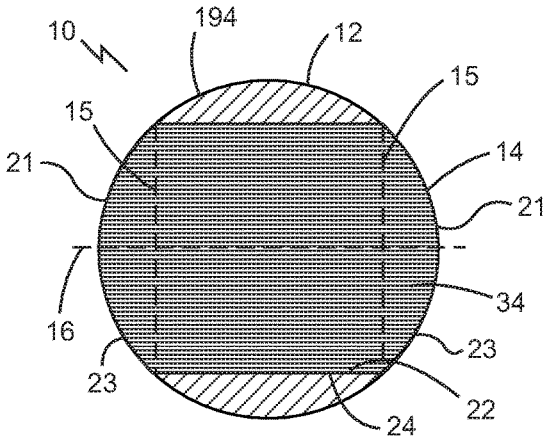
FIG. 1 is a section view of a frac ball.

Immaterial modifications may be made to the embodiments described here without departing from what is covered by the claims.

Tools incorporating valve assemblies having a plug, such as a ball or dart, and a plug seat, such as a ball seat or dart seat, have been used for a number of different operations in wells for oil gas and other hydrocarbons. These tools may be incorporated into a string of pipe or other tubular goods inserted into the well. The valve assemblies provide a defined location at which the flow of fluid past may be obstructed and, with the application of a desired pressure, a well operator can actuate one or more tools associated with the assembly.

Remotely operated valve assemblies may be used in a treatment, such as a fracturing treatment, of a subterranean formation adjacent to a well. Valves used for this purpose may open ports in the tubing to facilitate treatment of a selected area or section of the formation. The treatments are performed by pumping fluid through the wellhead, into the tubing string and out of the selectively opened ports. Examples of such well treatments include acidizing or fracturing. Acidizing cleans away acid soluble material near the well bore to open or enlarge the flow path for hydrocarbons into the well. Fracturing may be carried out by injecting fluids from the surface through the wellbore and into the formation at high pressure sufficient to create and force fractures to open wider and extend further. The injected frac fluids may contain a proppant, such as sand, which holds fractures open after the fluid pressure is reduced. While acidizing and fracturing are two examples of treatments that may be performed through the valve assemblies, the scope of the present disclosure is not limited to any particular formation treatment(s) and may include any other treatment, such as, without limitation, CO2 injection, treatment with scale inhibitors, iron control agents, corrosion inhibitors or others.

Treatments in plural-stage production or exploration wells may require selective actuation of downhole tools, such as sleeve assemblies, to control fluid flow from the tubing string to the formation. For example, a system may be used that has plural valve assemblies having ball-and-seat seals, each having a differently sized ball seat and corresponding ball. Such ball-and-seat arrangements are operated by placing an appropriately sized ball into the well bore and bringing the ball into contact with a corresponding ball seat. The ball engages on a section of the ball seat to block the flow of fluids past the valve assembly. Application of pressure to the valve assembly, such as through use of fluid pumps at the surface, may create a pressure differential across the valve assembly, causing the valve assembly to "shift" and thus open ports in the sleeve to the surrounding the formation. Other types of plugs such as darts, or any other suitable shape that can be used to selectively operate a valve assembly, may also be used to seal the seat and facilitate the creation of a pressure differential to shift the valve assembly and open the sleeve, or actuate a different tool, such as a plug and seat actuated flapper valve, associated with the valve assembly.

Downhole Drop Plugs

Referring to FIGS. 1-5, a downhole drop plug 10 is disclosed having a ring part 12 and a rod part 14. Referring to FIG. 1, ring part 12 defines an interior bore 22 and is made of one of a first or second structural material. Rod part 14 is illustrated as nested within the interior bore 22 of the ring part 12 and is made of the other of the first and second structural material. The first and second structural materials may be provided to balance the density and strength in drop plug 10 while still withstanding the extreme pressures of a fracturing process. A purely metal component may be too dense to efficiently flow into and out of the well, and thus the drop plug 10 may be a mix of metal and non-metal structural materials. If a full metal ball cannot be circulated out then the operator may need to drill or mill out the balls. Drill or mill out may be difficult with a ball made of pure aluminum, steel, or ceramic. In one case a structural material is a material that is capable of withstanding fracturing pressures.

The first structural material may have a higher yield strength than the second structural material. As an example, the first structural material has a yield strength of at least one and a half, two, or more times the yield strength of the second structural material. A yield strength or yield point is the material property defined as the stress at which a material begins to deform plastically. Prior to the yield point the material will deform elastically and will return to its original shape when the applied stress is removed. Once the yield point is passed, some fraction of the deformation will be permanent and non-reversible. In one embodiment, the first structural material may be a pure metal, such as aluminum, or alloy and the second structural material may be a non-metal. Thus, for example the first structural material has between 35,000 psi-150,000 psi or higher yield strength, and the second structural material has between 10,000 psi-60,000 psi or higher yield strength. In one case the ratio of yield strengths between the first and second structural materials ranges from 1.5:1 to 6:1. The ring part may comprise the first structural material, such as is shown in FIG. 1. In one case aluminum forms the first structural material (35,000 psi yield strength), and G10 composite (see below) forms the second structural material (22,000 psi yield strength). In one example the first structural material has a higher stiffness than the second structural material, for example at least two or more times higher. In examples the first structural material comprises aluminum (Young's modulus 10,000,000 psi), steel (Young's modulus 29,000,000 psi), or titanium (Young's modulus 16,000,000 psi) while the second structural material comprises G10 (Young's modulus 1,000,000 psi) or FR-4 (Young's modulus 3-3,500,000 psi).

In one case, the first and second structural materials have different densities, with the second structural material having a lower density than the first structural material. For example the second structural material has a density at or below 2 g/cm$^3$, and the first structural material has a density above 2.5 g/cm$^3$ for example above 5 g/cm$^3$. In one case the first structural material comprises aluminum (2.7 g/cm$^3$) or steel (7.6 g/cm$^3$) and the second structural material comprises G10 composite (1.85 g/cm$^3$). The overall yield strength, stiffness, density, and other properties of the downhole drop plug ends up being in between the respective values for the first and second structural material.

Figure 3:
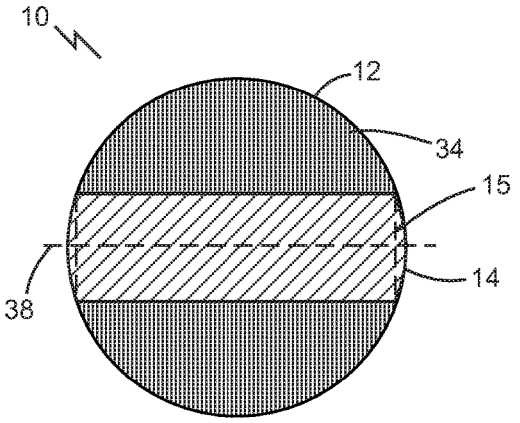
FIG. 3 is a section view of another embodiment of a frac ball.
Figure 4:
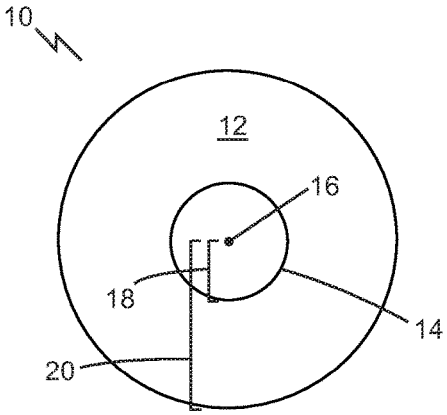
FIG. 4 is an end elevation view of the ball depicted in FIG. 3.
Figure 5:
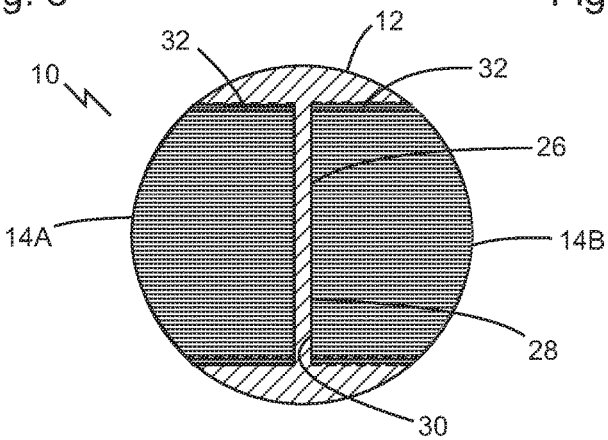
FIG. 5 is a section view of a further embodiment of a frac ball.

Referring to FIGS. 1-5, the ring part 12 and the rod part 14 of drop plug 10 may, in some cases, collectively form a sphere, also known as a drop ball or frac ball. Referring to FIG. 1, ring part 12 may also define first and second open axial ends 15 (shown in dashed lines in FIG. 1) spanned by first and second axial end surfaces 21, respectively, of the rod part 14. The embodiment of downhole drop plug 10 shown has a ring part 12 forming a spherical ring and the rod part 14 forming a cylinder 24 with opposed spherical caps 23. A spherical ring is also known as a napkin ring, or a sphere with a cylindrical hole drilled out. A spherical cap is the region of a sphere that lies beyond a given plane. The interior bore 22 of the ring part 12 may as shown extend continuously between the first and second open axial ends 15 (FIGS. 1-4). Referring to FIG. 5, in another case, the rod part 14 may comprise first and second rod parts 14A and 14B separated by an interior wall or plate 26 laterally extended across the interior bore 22 of ring part 12.

Figure 1A:
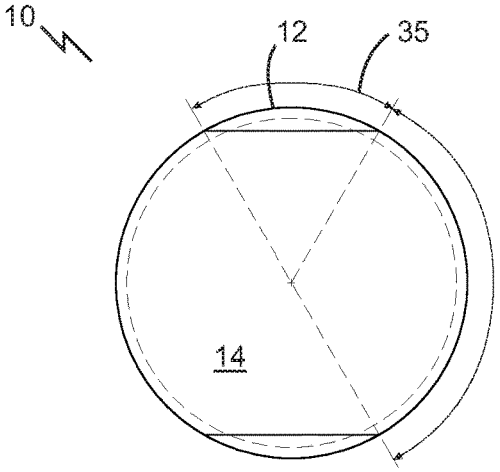
FIGS. 1A-1F are section views of various frac ball embodiments, with cross-hatching omitted for clarity, and dashed lines used to represent a) the contact area the ball makes with the seat in use, and b) the radial sizes of the ring part and rod part.
Figure 1B:
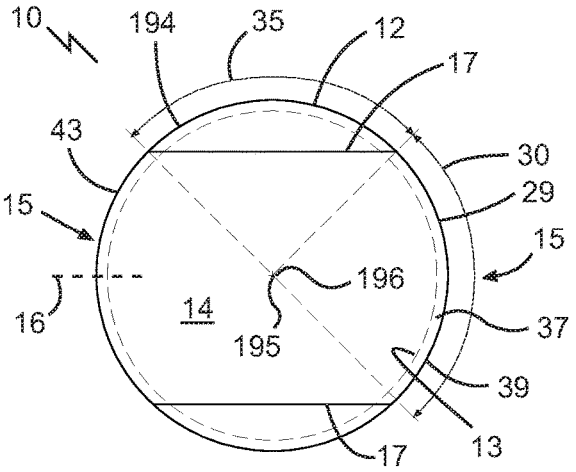
Figure 1C:
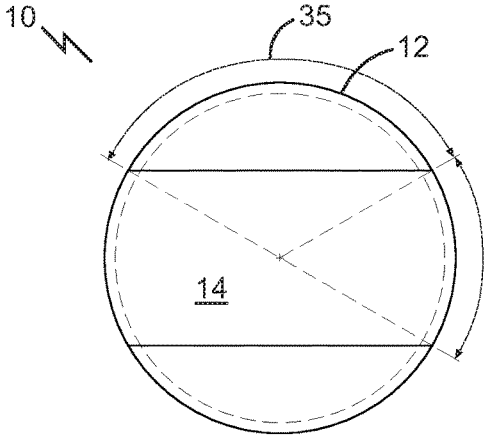
Figure 1D:
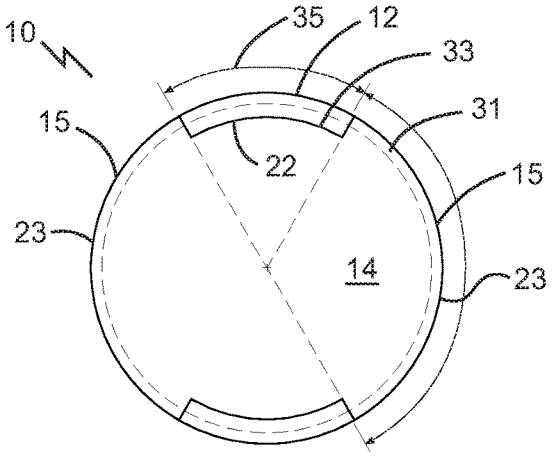

Referring to FIG. 1D, ring part 12 or cartridge may form a ring of a spherical shell, and the rod part 14 may form a sphere 31 with the ring part 12 fitting within a corresponding groove 33 in the exterior surface of the rod part 14. A spherical shell is understood to mean a sphere with a smaller spherical core volume removed, to define an interior bore 22 that has that follows the exterior contour of a sphere as shown. In the example the first and second axial end 15 surfaces also define spherical end caps 23 of rod part 14. A rod part 14 as shown in FIGS. 1D-1F may be formed within the ring part 12 by a suitable method such as in-ring casting or injection molding, in order to achieve the structure shown.

Referring to FIG. 1B, ring part 12 may have, in one case, a minimum radial distance 35, between the first and second open axial ends 15, that spans between 55 and 130 degrees. By contrast, the maximum radial distance 30 between ring support ends 17 of rod part 14 may span between 130 and 55 degrees, respectively. In the example shown the minimum radial distance 35 is ninety degrees. Referring to FIGS. 1A-F the minimum radial distance 35 may be between 60 degrees (FIGS. 1A and 1D) and 120 degrees (FIGS. 1C and 1F), for example between 80 and 100 degrees (FIGS. 1B and 1E). Referring to FIG. 1B, an interference area 37 is defined as the area of contact, as projected into the plane of the paper, between the plug 10 and the seat surface 29. In some cases (not shown) the drop plug 10 is not symmetric as shown. The area 37 is defined between a maximum circumference 39 of the plug 10 and an inner minimum circumference 13 of the seat surface 29. The area 37 illustrated is not the actual contact area as the ball 10 in the figures is three-dimensional, but the area 37 provides a representation of the ratio of contact between the part of rod part 14 that contacts the seat surface 29 and the part of the ring part 12 that contacts the seat surface 29. The distance 35 is referred to as a minimum radial distance because the distance 35 is measured when the plug 10 is seated on seat surface 29 in an orientation that represents either or both a maximum of contact between the ball carrier segment or rod part 14 and the seat surface 29, or a minimum of contact between the ring part 12 and the seat surface 29. In all seating orientations other than the one shown, the ring part 12 will have contact with the seat surface 29 over a radial distance that is equal to or greater than the minimum radial distance 35. In the figures the radial distances 30 and 35 are measured around an axis 196 drawn through the center of the plug 10 and perpendicular to the ring axis 16.

Figure 1E:
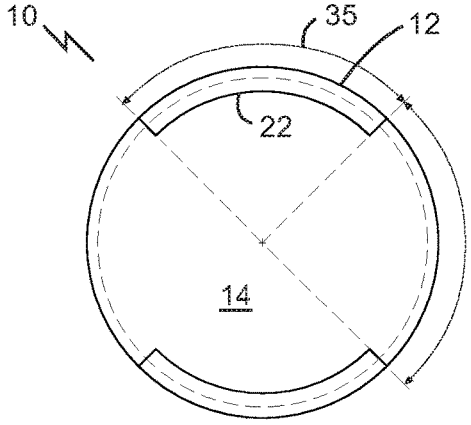
Figure 1F:
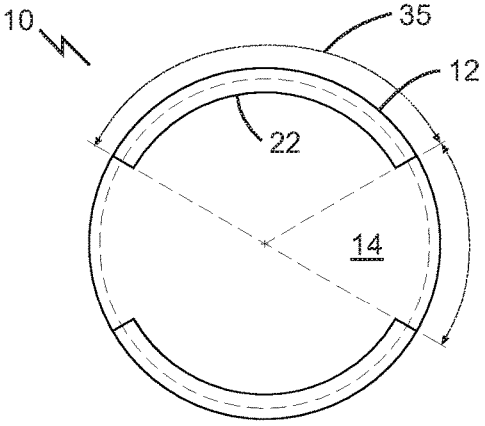

Referring to FIGS. 1A-F, the yield strengths of the resulting ball 10 shown may be calculated. If the first structural material composes the ring part 12, the second structural material composes the rod part 14, the first structural material is a high strength material with a yield strength of 2 units and a density of 2 g/cm$^3$, and the second structural material is a low specific gravity material with a yield strength of 1 unit and a density of 1 g/cm$^3$, the following calculations may be made. In FIGS. 1A and 1D the ratio of ring to rod interference area is 1:2 and the yield strength of the ball 10 is 1.33, representing a strength increase of 33% over a ba1110 made of purely second structural material. In FIGS. 1B and 1E the ratio of ring to rod interference area is 1:1 and the yield strength of the ball 10 is 1.5, representing a strength increase of 50% over a ba1110 made of purely second structural material. In FIG. 1B the density of the ball 10 would be 1.5 g/cm$^3$, representing a 50% decrease from pure first structural material. In FIGS. 1C and 1F the ratio of ring to rod interference area is 2:1 and the yield strength of the ball 10 is 1.66, representing a strength increase of 66% over a ball 10 made of purely second structural material. The yield strengths would also be expected to increase in different orientations, as the orientations shown represent orientations of minimum interference between ring part 12 and seat surface 29. In the example of a spherical plug 10, there may be an infinite plurality of possible seating orientations on the seat.

Figure 2:
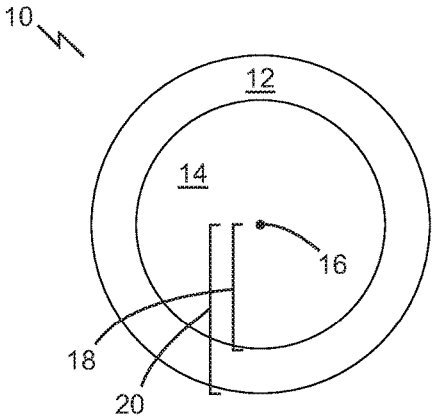
FIG. 2 is an end elevation view of the ball depicted in FIG. 1.

Referring to FIGS. 2 and 4, various methods may be used to quantify the proportional relationship between ring part 12 and rod part 14, in addition to or in supplement to the minimal radial distance method discussed above. For example the ratio of rod part 14 outer diameter 18 and ring part 12 inner diameter 20 may be between 1:3 (FIG. 4) and 4:5 (FIG. 2) as shown, or other suitable ranges. In one case the ring part 12 and the rod part 14 are dimensioned such that the first structural material accounts for a coverage of between 30-70% of an external seating surface area 43 of the sphere in a seating orientation that represents a minimum coverage by the first structural material, such as shown in FIG. 1B. External seating surface area 43 may have a contiguous, continuous, and/or flush transition between rod and ring as shown to permit seating across the transition. In the case of FIG. 1B the ring part 12 and the rod part 14 are dimensioned such that the first structural material forms the ring part 12 and accounts for a coverage of 50% of the external seating surface area 43 of a sphere in the seating orientation that represents the minimum coverage by the first structural material. In another case the volume ratio of the ring part and the rod part is between 0.4-6:1. Referring to FIGS. 1 and 3 the volume ratios of the balls 10 shown are 0.48:1 and 5.0:1, respectively.

Referring to FIG. 5, rod part 14 may be fixed against axial movement within the interior bore 22, for example a cylindrical bore as shown, of the ring part 12 by threaded connection 32. In other cases, rod and ring may be fixed via an adhesive, a press fit (for example interference or thermal), a weld (for example a friction weld, solder or braze), an in-ring casting, injection molding, or combinations thereof. Referring to FIG. 1B, spherical plug 10 may have a center of gravity located at the center 195 of the sphere 194. The sphere may define a plane of symmetry perpendicular to the axis 16 and crossing the geometric center 195. In some cases a plane of symmetry is defined parallel the axis 16 and crossing the geometric center 195, and in further cases both of the planes of symmetry of this and the preceding sentence are defined in the same ball 10. In some cases the actual center of gravity is slightly offset from the geometric center of the ball 10. In other cases the drop plug 10 is not symmetric, for example not symmetric about either or any plane of symmetry. In some cases heat may be applied during fixation, such as when inserting rod part 14 axially into ring part 12. Fixation may be carried out to a degree such that rod part 14 is fixed within ring part 12 to avoid shifting under operating such as fracturing pressures. The rod part 14 may conform to, for example hug, the interior volume defined by ring part 12, to avoid strength-reducing voids.

Referring to FIGS. 1 and 3, one of the structural materials may comprise a composite of a matrix of plural layers 34 of woven, for example cross-woven, or particulate material laminated in a solid adhesive polymer. In a further case, the matrix may comprise carbon or glass fiber. Referring to FIG. 1, when the composite makes up the rod or pin part 14, plural layers 34 may run with at least one directional component oriented along an axis 16 defined by the interior bore of the ring part, for example if layers 34 run parallel to axis 16 as shown. In one case the layers 34 run up to sixty degrees offset axis 16. Referring to FIG. 3, when the composite makes up the ring part 12, plural layers 34 may run with at least one directional component, defined by the layers 34, perpendicular to an axis 38 defined by the rod part 14, for example if layers 34 are perpendicular to axis 38. In one case the layers 34 run between ninety and thirty degrees offset axis 38. Orientation of layers 34 as above may be advantageous when the composite used is anisotropic, i.e. stronger in some directions than in others. Anisotropic layered materials may be shear-sensitive across the interface between layers 34. Thus, by orienting layers 34 in the manners shown in FIGS. 1 and 3, the seat surface 29 will never impart a force whose entire magnitude is directed against and parallel to the layers 34. The adhesive polymer may comprise polyether ether ketone (PEEK), Torlon, Teflon, PGA polyglycolic acid, plastic, or other suitable materials or epoxies. Glass, carbon, or other fillers may be added to increase the strength of the composite. In some cases between 20 and 60% filler may be used, for example 30% glass fibers, with G10 discussed below having 50% glass in one case. The composite may have a sufficient number of layers 34, such as 1000 layers of glass weave. The adhesive polymer may be injected into the fiber, particulate, or woven filler matrix under pressure, to wet the fibers. The resulting matrix provides the strength of glass in tension with the strength of epoxy under compression, and lacks the brittleness of the initial glass or carbon fiber.

Suitable composite materials may be chemically resistant, non-conductive, and resistant to degradation, such as by being insoluble in downhole fluids and acid so as to not degrade when contacted by wellbore fluids. Suitable materials include G10 and FR-4. Such materials may have relatively high strength, low moisture absorption, excellent electrical properties and chemical resistance. FR-4 and G10 are grade designations assigned to glass-reinforced epoxy laminate sheets, tubes, rods and printed circuit boards (PCB). FR-4 is a composite material composed of woven fiberglass cloth with an epoxy resin binder that is flame resistant (self-extinguishing). The "FR" stands for flame retardant, and denotes that safety of flammability of FR-4 is in compliance with the standard UL94V-0. FR-4 is created from the constituent materials (epoxy resin, woven glass fabric reinforcement, brominated flame retardant, etc.) by NEMA in 1968. FR-4 glass epoxy is a versatile high-pressure thermoset plastic laminate grade with good strength to weight ratios. With near zero water absorption, FR-4 is most commonly used as an electrical insulator possessing considerable mechanical strength. The material is known to retain its high mechanical values and electrical insulating qualities in both dry and humid conditions. Other grade designations for glass epoxy laminates are: G10, G11, FR4, FR5 and FR6. G-10, the predecessor to FR-4, lacks FR-4's self-extinguishing flammability characteristics. In some cases a degradable material, such as PGA polyglycolic acid, may be used for one of the structural materials.

Composite parts may be manufactured by suitable methods including filament winding, table rolling and resin transfer molding. In some cases composites are cut from a sheet into squares or other suitable shapes, and milled or ground down into a rod, ball or other desired plug shape, in a fashion similar to the machining of a metal product. Referring to FIG. 1, both the ring part 12 and rod part 14 may be formed or machined into a sphere, and milled down to the shapes shown, then combined.

Balls or downhole plugs 10 disclosed here, for example one or both of the first and second structural materials, may be made of drillable materials. The word drillable may refer to a material that has same or better drilling performance as machining mild steel, which has a yield strength of less than 60,000 psi and more commonly in the 45,000 psi range. Drillable materials include mild steels, ductile cast irons, grey cast irons, aluminum alloys, brass alloys, soft metals, and various non-metals, such as composite materials. Composites such as filled plastics and filled epoxy composites may reach 35,000 psi yield strengths and higher. In some cases materials with yield strengths in the 45,000 psi yield strength range exhibit good to excellent machining properties and are thus drillable. Most steels and ceramics are difficult to drill or mill out, and are not considered to be drillable. In some cases one of the structural materials, for example the ring part, may be made of a material, such as aluminum, that is drillable but may be difficult to drill if such makes up the entire structure of a drop plug 10. When in ring or rod form, materials such as aluminum, as well as non-drillable materials, may be made more drillable because there is less aluminum by volume.

Referring to FIG. 1, in some cases the first structural material and second structural materials comprise a first metal and a second metal, respectively. The first metal, such as a magnesium rod, may dissolves in the presence of an electrolyte. The second metal, such as copper, may be in electrical contact with the first metal, and may accelerate the rate of dissolution of the first metal when the first metal and second metal are exposed to the electrolyte. In some cases the nature of the first metal and second metal is reversed, so that the first metal accelerates dissolution of the second metal. Either metal may form the ring part or rod part.

Downhole Valves

If the well or tubing contains plural downhole valves, plugs of various sizes may be used to each target a particular downhole valve. In such a case each plug 10 will be small enough so that it will not seal against any of the seats it encounters prior to reaching the desired seat. For this reason, the smallest ball to be used for the planned operation is often the first ball placed into the well or tubing and the smallest ball seat is positioned in the well or tubing the furthest from the wellhead, for example at the toe end of a deviated well. After the desired treatments are completed, the direction of fluid flow may be reversed so that the treating fluids and formation fluids may be produced through the wellhead. Because each plug is smaller than the seats past which it traveled, in theory the plugs are free to move in an uphole direction with the fluids through the previously passed plug seats and out of the well.

Downhole valves, which rely solely on the size of the plug and the seat opening for selecting the tool to actuate, limit the number of valves that can be used in a given tubing string, usually to around twenty to forty valves. In such systems each ball size is able to actuate a single valve and, each plug may have a diameter increase within a predetermined increment, such as 0.125 inches, larger than the immediately preceding plug. The size of the liner, tubing, or well bore may thus restrict the number of valve assemblies that can be used with differently-sized ball seats. The diametrical clearance between the ball and the above seat may be for example between 0.002 to 0.030 inches, which may be smaller than the incremental diametric difference between balls. Such systems operate more efficiently when drop balls remain in tolerance when seated during the frac because then the balls can be retrieved. If such drop balls become deformed, retrieving the balls may be problematic, and if impossible the only recourse may be to drill or mill out the balls that are obstructing the tubing.

Figure 6:
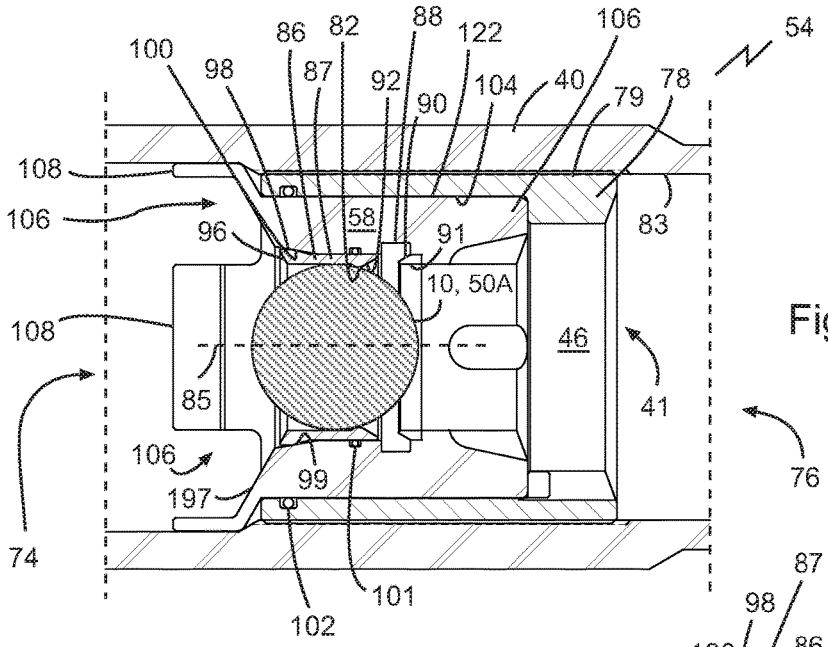
FIGS. 6-9 are side section views illustrating part of a downhole valve with a compound seat. The figures illustrate a method of using the downhole valve to pass a first ball downhole while seating a second ball with the same dimensions as the first ball (FIGS. 6-8), and then lodging the first ball on flow back to expose a bypass around the downhole valve.
Figure 7:
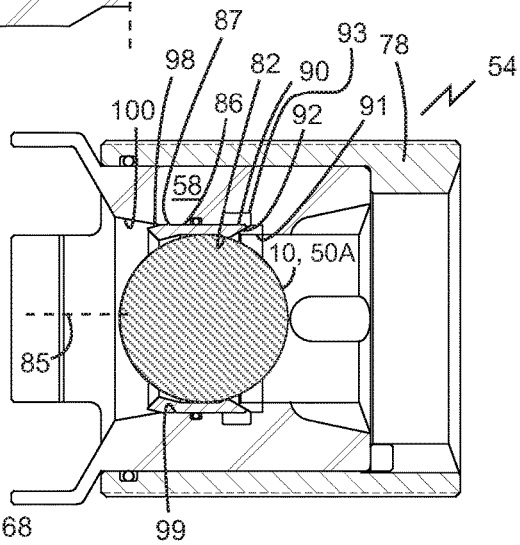
Figure 8:
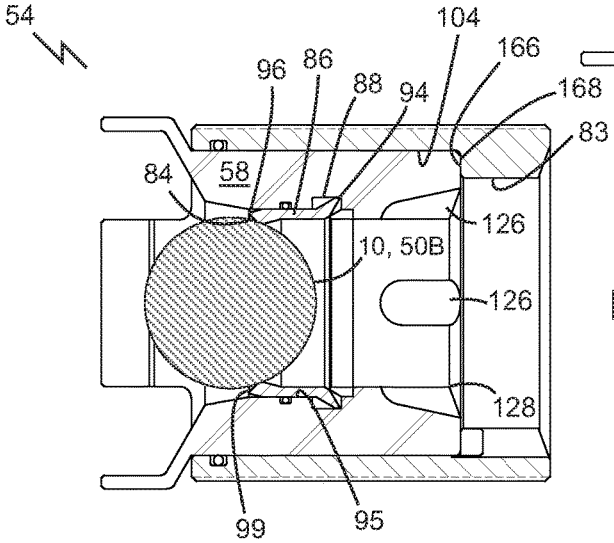

Referring to FIG. 6, a downhole valve 54 is illustrated with an outer housing 40, and an inner mandrel 41, forming a compound seat. The outer housing 40 defines an interior bore 83. Mandrel 41 is mounted, for example by threaded connection as shown, in the interior bore 83. The inner mandrel 41 defines an interior passageway 46 between an uphole end 74 and a downhole end 76 of the inner mandrel 41. Referring to FIGS. 6-8 in one embodiment the inner mandrel 41 has a first position (FIG. 6) where the inner mandrel 41 is actuatable by a first drop plug 50B to pass the first drop plug 50A downhole and shift to a second position (FIG. 8). Referring to FIG. 8, when shifting into the second position shown the inner mandrel 41 may form an uphole facing drop plug seat surface 84. Seat surface 84 may encircle the interior passageway 46 and may be sized to receive a second drop plug 50B that has the same dimensions as the first drop plug 50A. In the embodiment shown, when in the seated position under pressure from uphole against a drop plug 50B, the fluid flow across the valve 54 is fully blocked. A mandrel may be a bar, shaft or spindle around which other components are arranged or assembled. The term mandrel has been extended in oil and gas well terminology to include tubular components that may or may not slide within the outer housing 40.

Referring to FIG. 6, the inner mandrel 41 may further comprise a sleeve part 86 mounted to shift along an axis 85 of the interior bore 83, for example in a downhole direction. When the inner mandrel 41 is in the first position, the sleeve part 86 may form an uphole facing actuator surface that is positioned to receive the first drop plug 50A. An example uphole facing actuator surface is a first uphole facing seat surface 82, which may have a consistent cross-sectional shape about axis 85, and may encircle the interior passageway 46 and be sized to receive first drop plug 50A as shown. Referring to FIGS. 7-8, while the inner mandrel 41 is in the second position (FIG. 8), and in some cases while moving into (FIG. 7), the sleeve part 86 may form the uphole facing drop plug seat surface 82, which will be referred to as a second uphole facing drop plug seat surface 82 in distinction with first surface 84.

Referring to FIGS. 6-7, the downhole valve 54 may comprise a first deflector part, such as a deflection ring 91, which may be a separate piece connected, for example by threading, to inner mandrel 41 or outer housing 40, or may be machined in place to the inner mandrel 41 or outer housing 40. Ring 91 may push, for example guide, the sleeve part 86 radially outward to defeat the first surface 84 to pass the first drop plug 50A. The ring 91 may be structured to contact, during actuation, a downhole facing surface, such as nose ramp 92, of the sleeve part 86 to push the sleeve part 86 radially outward.

Referring to FIGS. 6 and 7, when the inner mandrel 41 is in the first position, the ring 91 may stand in the path, for example in a downhole direction along axis 85, of the nose ramp 92. One or both the ring 91 and a downhole portion, such as nose ramp 92, of an outer wall 87 of the sleeve part 86 may be sloped to cooperate to push the sleeve part 86 radially outward when the inner mandrel 41 is moving from the first position to the second position. In the example shown, both nose ramp 92 and ring 91 are sloped. Thus, an uphole facing surface 90 of ring 91 may be sloped radially outward with increasing distance from the nose ramp 92, and the downhole facing surface, such as nose ramp 92, may be sloped radially inward with increasing distance from the ring 91. The sloping of nose ramp 92 may extend to the first seat surface 82 as shown. The first deflector part need not be a ring 91, and may be a suitable deflection mechanism, such as dogs, balls, latches, pins, or guides. The use of a first deflector part, which operates using energy from the pressurized drop plug 50A, may act to reduce the pressure threshold, for example to less than 2000 psi and in some cases 1500 psi or less, required to shift from first to second position. Part of the reason for the reduced pressure threshold is that the first deflector part and second deflector part convert the axially directed force of the sleeve part 86, imparted by ball 50A, into lateral (radial) force to expand the seat surface 82 and contract the seat surface 84 while at the same time increasing such lateral force by a force advantage from the structures of the first and second deflector parts, for example shallow slope wedges as shown. In one case the pressure required to defeat the first seat surface 82 is 1500 psi or less, for example 1000 psi or less. Reducing the pressure threshold reduces the chance that ball 50A will be deformed during the pressure up.

Referring to FIGS. 7-8, the outer housing (tool body) 40, or in this case the inner mandrel 41, may form a stop surface, such as uphole facing stop surface 93, that contacts a downhole facing surface, such as downhole end 94 of the sleeve part 86, when the inner mandrel 41 is in the second position. The stop surface 93 may form a downhole end wall of a recess 88 that extends radially outward from ring 91 in order to provide a channel for the downhole end 94 of sleeve part 86 to deflect radially outward into. Once in contact with stop surface 93, further downhole axial movement of the sleeve part 86 is restricted, permitting a relatively larger capacity for pressure tolerance when seating drop plug 50B, as compared to if no stop surface were used. Recess 88 may be an annular groove within an interior cylindrical wall surface 95 of inner mandrel 41 or outer housing 40, the surface 95 providing a cylinder in which sleeve part 86 is permitted to slide axially.

Referring to FIGS. 7-8, a second deflector part, such as a ramp part 100 within wall surface 95 of inner mandrel 41, may bend the sleeve part 86 radially inward to form the second seat surface 84. Second seat surface 84 may act as a bidirectional seat for balls 50A and 50B, although in some cases sleeve part 86 is configured to reset to the first position after seating ball 50A under flow back and upon application of force in an uphole direction against ball 50A. Referring to FIG. 6, when the inner mandrel 41 is in the first position, one or both the ramp part 100 and the restriction 99 may stand in the path, for example in a downhole direction along axis 85, of an uphole portion, such as flared tail ramp 98, of an outer wall 87 of the sleeve part 86. Referring to FIGS. 6-8, one or both the ramp part 100 and the tail ramp 98, in this case both, are sloped to cooperate to push the sleeve part 86 radially inward when the inner mandrel 41 is moving from the first position to the second position. The second deflector part, for example ramp part 100, may be sloped radially inward with increasing distance from the tail ramp 98 of the outer wall 87, and the tail ramp 98 may be sloped radially inward, at least initially, with decreasing distance from the ramp part 100.

The second deflector part may comprise a cylindrical inner wall, such as wall surface 95 of restriction 99, that encircles the outer wall 87, and the second deflector part may have a part, such as ramp part 100, that narrows radially inward to the cylindrical inner wall 87 in the downhole direction. The outer wall 87 may conform to the shape of the cylindrical inner wall surface 95 in an axial direction, for example all the way between the restriction 99 and the uphole portion of the outer wall 87, at least when the inner mandrel 41 is in the second position. Such a configuration reduces or eliminates voids between sleeve part 86 and inner wall surface 95, increasing the structural integrity, and capacity, to withstand relatively higher pressures when the valve 54 is closed as compared to a valve 54 that has a void between wall surfaces 95 and 87.

In one case the second seat surface 84 may be defined on or adjacent a free uphole end 96 of the sleeve part 86. By positioning the second seat surface 84 on a free terminal end, there is relatively less resistance to the deformation that occurs to form seat surface 84 while shifting to the second position. Thus, the pressure threshold required to shift from first to second position is further reduced relative to a system that bends an intermediate part of sleeve part 86 inwards.

The compound seat sleeve part 86 may be made of a suitable material such as a ductile material. Ductile materials may be drillable or non-drillable, and include ductile cast iron or a medium strength aluminum alloy. Non-drillable and other hard materials may be used to make the compound seat sleeve part 86 without a significantly negative impact on drillability, because the sleeve part 86 may take up only a relatively small volume compared to the volume of the rest of the inner mandrel 41, which may comprise drillable materials such as ductile cast iron.

Figure 9:
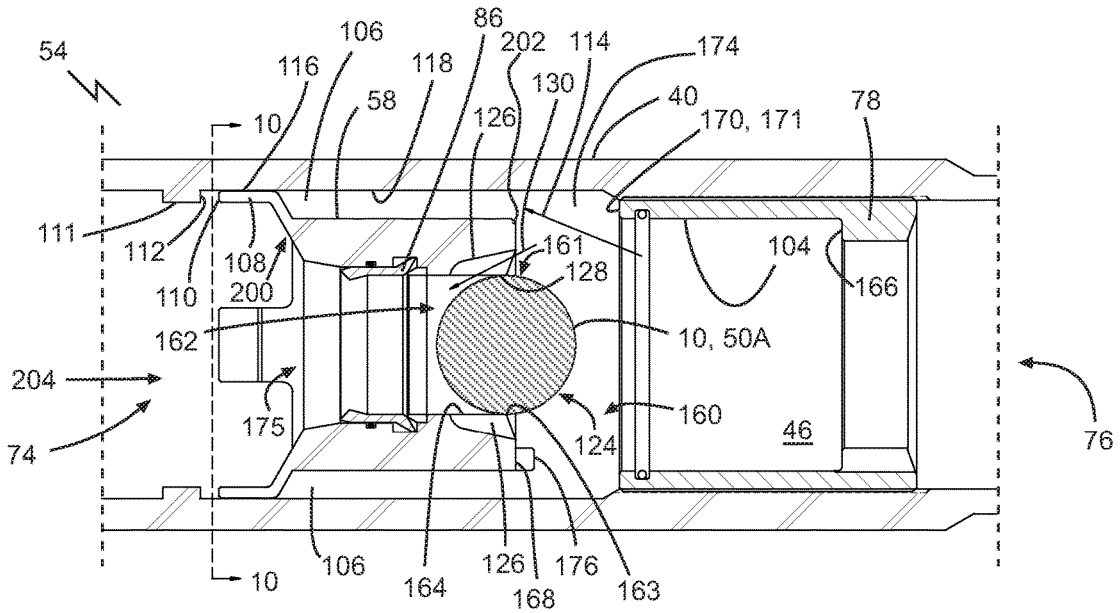
Figure 12:
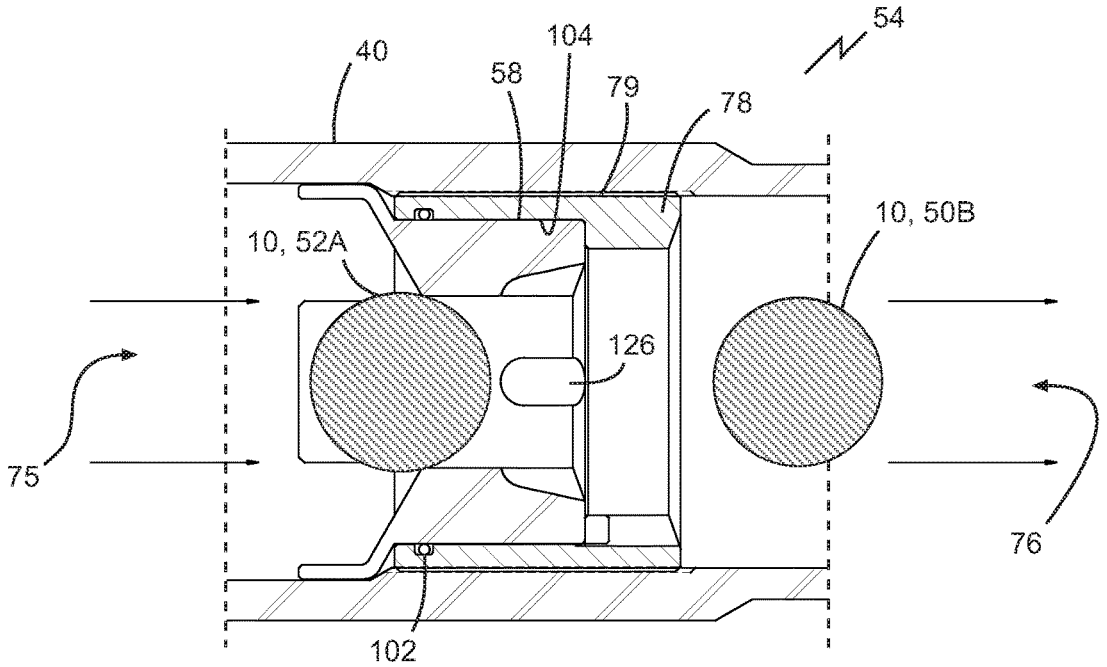
FIGS. 12 and 13 are section views of a further downhole valve lacking a compound seat, and illustrating a method of passing a first ball, seating a second ball (FIG. 12), and lodging the first ball on flow back to expose a bypass around the downhole valve (FIG. 13).
Figure 24:
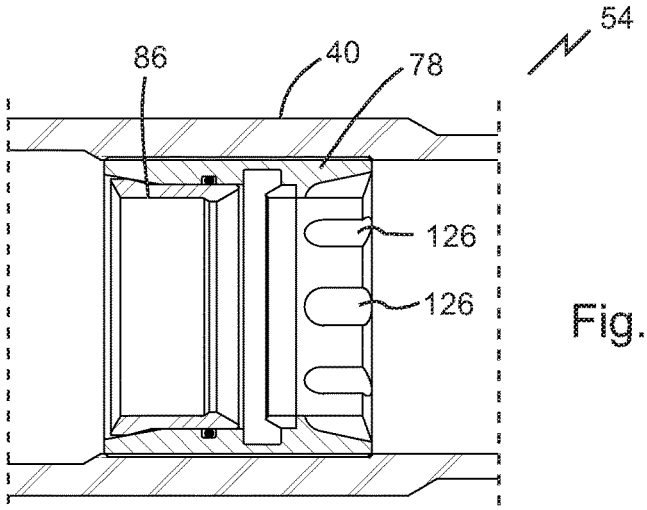
FIG. 24 is a section view of a further embodiment of a downhole valve with a compound seat and bypass grooves.

Referring to FIG. 9, the downhole valve 54 may be structured to expose a bypass 160 across the inner mandrel 41 at least upon receipt of, and application of fluid pressure in an uphole direction against, an object, such as first drop plug 50A, on a downhole facing restriction surface 128 defined within the interior bore 83. As shown, several options may be used for locating the bypass 160 within the interior bore 83. In one case the bypass 160 comprises a plurality of flow paths, such as grooves 126 in the downhole facing restriction surface 128, communicating between a downhole end 161 and an uphole end 162 of the downhole facing restriction surface 128. Referring to FIGS. 12 and 24, different configurations, sizes, radial depths, and radial spacing between, grooves 126 may be used as is suitable to increase minimum flow area across the downhole facing restriction surface 128, to reduce and in some cases eliminate a pressure drop across the valve when a ball 50 lodges on surface 128. Referring to FIG. 9 the grooves 126 may be radially spaced about restriction surface 128. The bypass 160 may be defined such that the various paths, such as lines 130 or 114, that make up the bypass 160, all maintain axial directional continuity from the downhole end to the uphole end of the bypass 160, to reduce friction and pressure drop through purely lateral or other complex paths. Sloped surfaces and rounded corners and edges may be incorporated to further improve laminar flow across the bypass 160. In some cases interior passages may replace or supplement grooves 126.

Restriction surface 128 may encircle the interior passageway 46 to form a seat for a downhole object such as ball 50A returned under flow back. The downhole facing restriction surface 128 may connect adjacent, and be located in a downhole direction relative to, a restriction 163 in the interior passageway 46. The restriction 163 may form an inner cylindrical wall surface 164 that extends in an uphole direction to sleeve part 86 if present. The restriction 163 part may form a close tolerance fit with a drop plug 50A of a maximum size capable of passing through the downhole valve 54 in a downhole direction, for example capable of passing through sleeve part 86 when sleeve part 86 is in the first position. Thus, as long as ball 50A retains the initial shape ball 50A had when ball 50A originally passed downhole valve heading downhole, under reverse flow the ball 50A ought to pass through restriction 163 freely, in order to be collected above surface to provide a relatively free flowing well bore. However, in many cases downhole drop plugs become plastically deformed as a result of the large pressures exerted upon such plugs during seating, pressure up, and fracturing. Once a ball 50A is deformed, such a ball 50A is likely to jam or otherwise lodge within cylindrical inner wall surface 164.

Referring to FIGS. 8 and 9, the inner mandrel 41 may comprise a sleeve part, such as a stem part 58. The downhole facing restriction surface 128 may be located on the stem part 58. The stem part 58 may be cylindrical and mounted to slide, in piston fashion, axially within a receptacle 104. Receptacle 104 may be defined within the interior bore 83. Under flow back pressure without the influence of a downhole object, or under flow back pressure with a downhole object such as drop plug 50A lodged against restriction surface 128, stem part 58 may slide in an uphole direction between a seated position (FIG. 8), where a downhole facing surface 168 such as is defined at a downhole end of sleeve part 58, seats, for example forms a pressure seal, against uphole facing stop surface 166, and an unseated position (FIG. 9) where the bypass 160 is exposed. Referring to FIG. 9, when in the unseated position surfaces 166 and 168 are axially separated.

Referring to FIG. 9, when the stem part 58 is a cylindrical stem, the interior wall, namely wall surface 164, of the stem part 58 may define part or all of the interior passageway 46 of the inner mandrel 41. The stem part 58 may be positioned coaxially within the outer housing 40 as shown. The receptacle 104 may be located on a collar part, such as housing 78 of inner mandrel 41 or as a part that integrally extends radially inward from outer housing 40. The collar part, such as housing 78, may have an uphole facing surface 171 that extends radially inward from an inner bore surface 118, of the outer housing 40, the inner bore surface 118 being positioned in an uphole direction related to surface 171. The uphole facing surface 171 may encircle an uphole end 172 of the receptacle 104. The surfaces 171 and 118 may define a recess, such as an annular recess 174 with a wider diameter than the receptacle 104, and the inner mandrel 41 may further comprise a centralizer flange 204. The flange 204, seat surface 84, and stem part 58 may be referred to as a check seat. The stem part 58 may be mounted to freely slide into or out of receptacle 104 under varying pressure differentials across the inner mandrel 41. Housing 78 may share a threaded connection 79 with outer housing 40, and may be provided as a separate module that can be inserted, removed, and retrofitted, into a housing 40.

Figure 10:
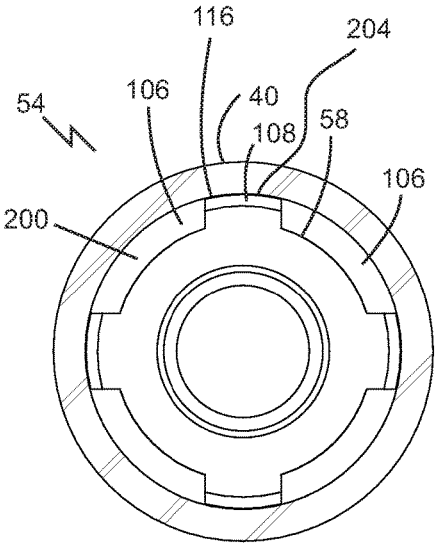
FIG. 10 is a section view taken along the 10-10 section line from FIG. 9.
Figure 11:
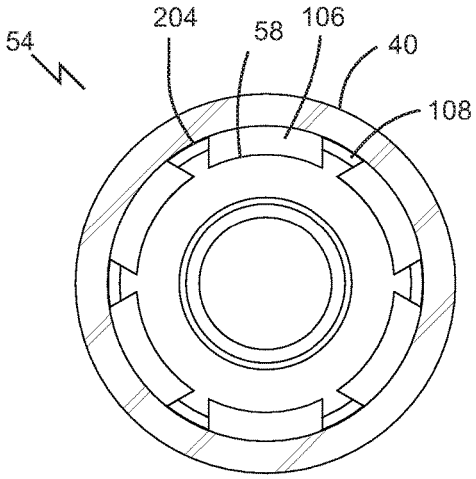
FIG. 11 is a section view of a further embodiment of a downhole valve but taken from the same location in the further downhole valve as the 10-10 section lines were taken from the valve from FIG. 9.

Referring to FIGS. 9, 10, and 11, the centralizer flange 204 may be defined by a plurality of fins 108, that extend radially outward from an uphole end 175 of the stem part 58 toward the inner bore surface 118 into the annular recess 174. The centralizer flange may have or define an axial passage or passages, such as is defined by the gaps 200 between a plurality of fins 108 radially spaced from one another, the fins 108 forming part of the centralizer flange. Gaps 200 may define part or all of the bypass 160. Thus, upon surface 128 seating ball 50A under flow back, pressure from downhole acts against ball 50A and translates ball 50A and stem part 58 together in an uphole direction. Referring to FIG. 9, once stem part 58 clears uphole end 170 of housing 78, or at an earlier point if housing 78 defines bypass grooves or interior passageways in the receptacle 104 wall or interior to the uphole end 170, bypass 160 is defined within the annular space between stem part 58 and inner wall surface 118, and in the gaps 200 between fins 108. A downhole facing stop surface 112 may be located in the interior bore 83 in an uphole direction from the receptacle 104 for contacting an uphole facing surface 110, and restricting uphole travel, of the centralizer flange. Such a structure leverages the relative large flow area in the outer annulus between the stem part 58 and surface 118. The centralizer flange also acts to centralize the stem part 58, such that, on normal flow in a downhole direction, the stem part 58 is able to center and enter the receptacle 104, if the stem part 58 has for whatever reason unseated itself from the receptacle 104. Such structure also permits re-setting, at least in embodiments that lack a compound seat that cannot be shifted back into the first position under reverse flow. Each fin 108 may define an outer wall surface 116 that contacts and slides along surface 118 and may provide the centralizing function of the centralizing flange. An uphole facing surface 197 of each fin 108 may be sloped radially inward with decreasing distance downhole. One or both the leading downhole facing surfaces 202 of stem part 58 may be sloped radially inward with decreasing distance from surface 166 or the uphole facing end 170 of housing 78 may be sloped radially inward with increasing distance from the stem part 58, to funnel or guide the ball 50 into the interior passageway 46.

Figure 13:
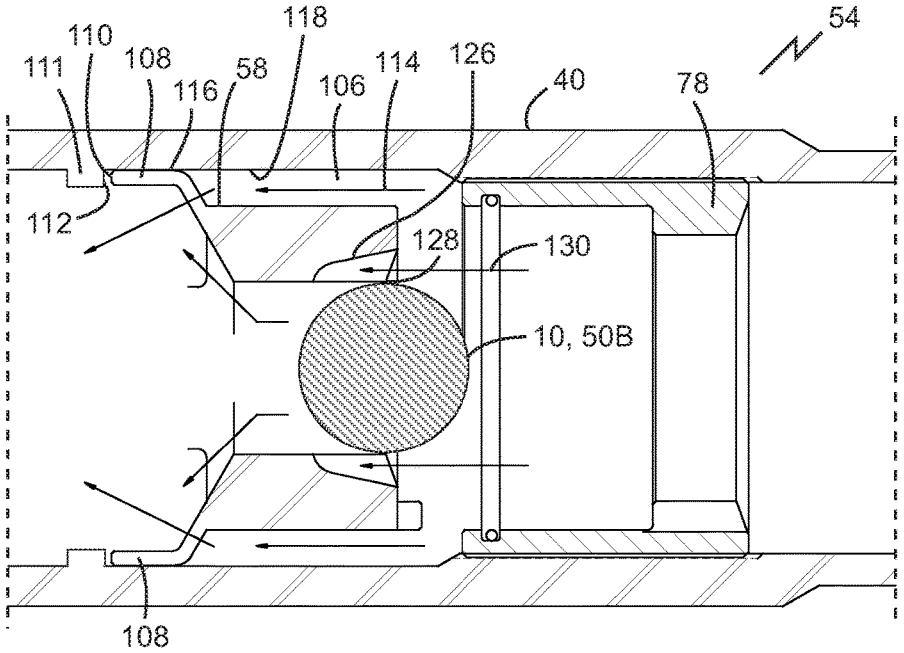
Figure 25:
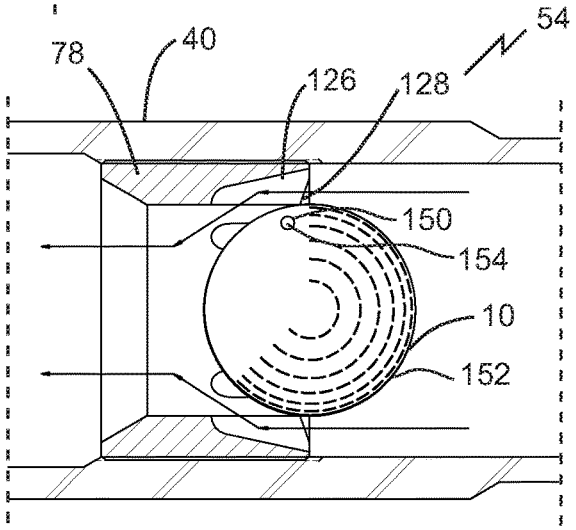
FIG. 25 is a section view of a further downhole valve with a frac ball sitting in a downhole facing restriction surface under reverse flow across the downhole valve through a plurality of bypass grooves, in which the frac ball has a window penetrating a protective outer coating and exposing a pure magnesium core.
Figure 26:
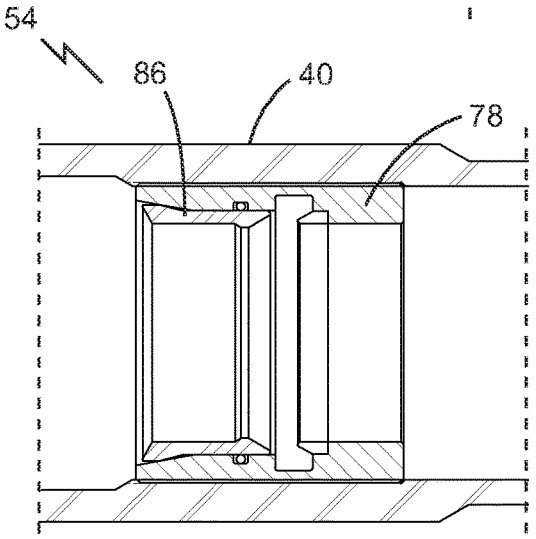
FIG. 26 is a section view of a further embodiment of a downhole valve with a compound seat.

Referring to FIGS. 12 and 13, an example is illustrated of a valve 54 that incorporates stem part 56 and housing 78 but lacks the compound seat of valve 54 from FIG. 6. Thus, valve 54 is not able to pass a ball of the same diameter required to seat the valve 54. Referring to FIG. 25, a further embodiment of a valve 54 is shown lacking a compound seat but having a bypass in the form of grooves 126 in a downhole facing restriction surface 128 in a housing 78 threaded to outer housing 40. Referring to FIGS. 24 and 26, embodiments of valve 54 with a compound seat sleeve part 86 are shown, but lacking a cylindrical stem part 58 and receptacle 104. The FIG. 26 embodiment lacks a bypass 160 altogether. In some stages bypass 130 may be eliminated to ease manufacturing. In some cases bypass path 114 provides a greater minimum flow area than bypass 130.

In some cases the valve 54 may incorporate stem part 56 and receptacle 104 to define bypass path 114 when stem part 56 is unseated, but with or without grooves 126 or bypass 130 path. When a drop plug is landed on a seat and pressured up at some point the drop plug can start to plastically deform, subsequently requiring a reverse pressure of 2000, 5000 psi, or more to unseat, particularly if the drop plug becomes extruded into the seat bore. One advantage of having a compound seat and bypass path 114 is that if the drop plug becomes stuck on the uphole facing seat surface 84 during pressure up, internal bypass is still possible without unseating the drop plug because flow back pressure need only dislodge stem part 56 to expose bypass path 114 in order to overcome the blockage. In some cases if the drop plug is stuck on seat surface 84 the stem part 56 requires lower pressure to unseat than the drop plug requires to unseat from the seat surface 84. For example, the stem part 56 may require 500 or less, for example 200-400 psi, to unseat. By contrast, in an example with a compound seat and only bypass 130, if the drop plug became stuck on the seat no internal bypass is possible without first unseating the drop plug under pressure.

The bypass 160, for example annulus 106, grooves 126, or both combined, may have a minimum cross-sectional flow area that is equal to 0.3 or more times a minimum cross-sectional flow area of the interior passageway 46 of the inner mandrel 41. The minimum cross-sectional flow area of the interior passageway 46 is understood to be calculated when the restriction surface 128 has not been obstructed or blocked to any degree by a downhole object or drop plug. In the examples shown the minimum cross-sectional flow area of the interior passageway 46 of the unrestricted valve 54 is defined as the bore area bounded by the seat surface 84 in a plane perpendicular to the axis 85, and is referred to in Tables 1-3 below as the ball seat area. The minimum cross-sectional flow area of the flow path 114 is defined by the area of the annulus 106 in a plane perpendicular to the axis 85, and the minimum cross-sectional flow area of the flow path 130 is defined by the combined cross-sectional areas of the grooves 126 measured at the point along each groove 126 that represents the minimum flow area of each groove 126. Thus, when both annulus 106 and grooves 126 are present the minimum cross-sectional flow area of the bypass may be the combined flow areas of annulus 106 and grooves 126 (see Table 1).

In further cases the bypass 160 has a minimum cross-sectional flow area that is equal to one or more times, for example between one and ten times (see Table 1), the minimum cross-sectional flow area of the interior passageway 46 of the inner mandrel 41. In some cases all or a plurality of the valves 54 along the tubing string may incorporate bypasses that are sized to permit at or above the minimum flow areas discussed above. In some cases (Table 3) the minimum cross-sectional flow area defined by grooves 126 or the functionally equivalent structure is one or more times the minimum cross-sectional flow area of the passageway 46. For example, a tubing string may incorporate a series of valves arranged from smallest ball seat diameter at the toe end of the string, to largest ball seat diameter closest to the uphole end of the tubing string. In Table 3, a group of such valves in a string each define a bypass flow area (measured by grooves 126) that is one or more times the minimum flow area of the respective valve passageway 46, with the group including at least those valves whose ball seat diameters are 75% or less the maximum ball seat diameter of the valves in the string. As shown in Table 1, in some cases all of the valves in the string may have a bypass flow area that is one or more times the minimum cross-sectional flow area of the passageway 46 of the respective valve 54. As shown in Table 1, the use of grooves 126 and fins 108/annulus 106 in the same valve 54 provide synergy by combining inner and outer bypass paths, across lines 130 and 114, respectively, in order to increase the flow rate across the valve 54, and reduce the impact of a lodged ball 50A, in some cases reducing such impact to the point where the valve 54 need not be drilled or milled out. In case drill or mill-out is still desired, drillable materials may be provided for the inner components of the valve 54, and a rotational lock 176 may be provided between the stem part 58 and the outer housing 40, for example between stem part 58 and housing 78 that threads to outer housing 40. Table 2 shows an example for a valve that either lacks grooves 126 or that has a ball 50B stuck on the uphole facing seat surface 84.

TABLE 1

Comparison of bypass flow area (inches$^2$) available across downhole valves sized for various ball sizes, with the downhole valves incorporating bypasses through annulus 106 and grooves 126, and with a ball seated on the downhole facing restriction surface 128.

| Ball Seat Diameter (inches) | Area Bounded by the Ball Seat surface 84 | Stem Annulus 106 Area | Grooves 126 Area | Combined Bypass Area | Total Bypass as a % of Ball Seat Area |
|---|---|---|---|---|---|
| 3.000 | 7.069 | 7.069 | 0.720 | 7.789 | 110 |
| 2.800 | 6.153 | 7.069 | 1.372 | 8.441 | 137 |
| 2.250 | 3.976 | 7.069 | 4.200 | 11.269 | 283 |
| 1.800 | 2.545 | 7.069 | 2.700 | 9.769 | 384 |
| 1.500 | 1.767 | 7.069 | 1.800 | 8.869 | 502 |
| 1.000 | 0.785 | 7.069 | 0.900 | 7.969 | 1015 |

TABLE 2

Comparison of bypass flow area (inches$^2$) available across downhole valves sized for various ball sizes, with the downhole valves incorporating bypass through annulus 106, and with a ball seated on the uphole facing seat surface 84 so as to block grooves 126. This data would be the same if no grooves 126 were present and a ball were seated on the downhole facing restriction surface 128 instead of on the surface 84.

| Ball Seat Diameter (inches) | Area Bounded by the Ball Seat surface 84 | Stem Annulus 106 Area | Grooves 126 Area | Combined Bypass Area | Total Bypass as a % of Ball Seat Area |
|---|---|---|---|---|---|
| 3.000 | 7.069 | 7.069 | 0.000 | 7.069 | 100 |
| 2.800 | 7.069 | 7.069 | 0.000 | 7.069 | 115 |
| 2.250 | 7.069 | 7.069 | 0.000 | 7.069 | 178 |
| 1.800 | 7.069 | 7.069 | 0.000 | 7.069 | 278 |
| 1.500 | 7.069 | 7.069 | 0.000 | 7.069 | 400 |
| 1.000 | 7.069 | 7.069 | 0.000 | 7.069 | 901 |

TABLE 3

Comparison of bypass flow area (inches$^2$) available across downhole valves sized for various ball sizes, with the downhole valves incorporating bypass through grooves 126 (no annulus 106), and with a ball seated on the downhole facing restriction surface 128.

| Ball Seat Diameter (inches) | Area Bounded by the Ball Seat surface 84 | Grooves 126 Area | Grooves 126 Bypass as a % of Ball Seat Area |
|---|---|---|---|
| 3.000 | 7.069 | 0.720 | 10 |
| 2.800 | 6.153 | 1.372 | 22 |
| 2.250 | 3.976 | 4.200 | 106 |
| 1.800 | 2.545 | 2.700 | 106 |
| 1.500 | 1.767 | 1.800 | 102 |
| 1.000 | 0.785 | 0.900 | 115 |

Figure 27:
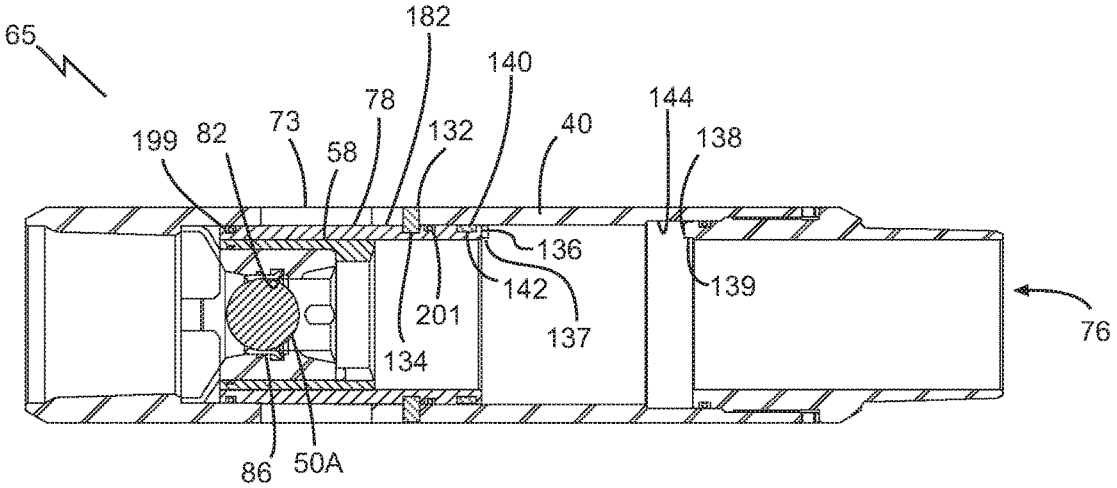
FIGS. 27 and 28 are section views depicting the operation of a frac sleeve from FIG. 14, the frac sleeve incorporating a compound seat and a cylindrical bypass stem.
Figure 28:
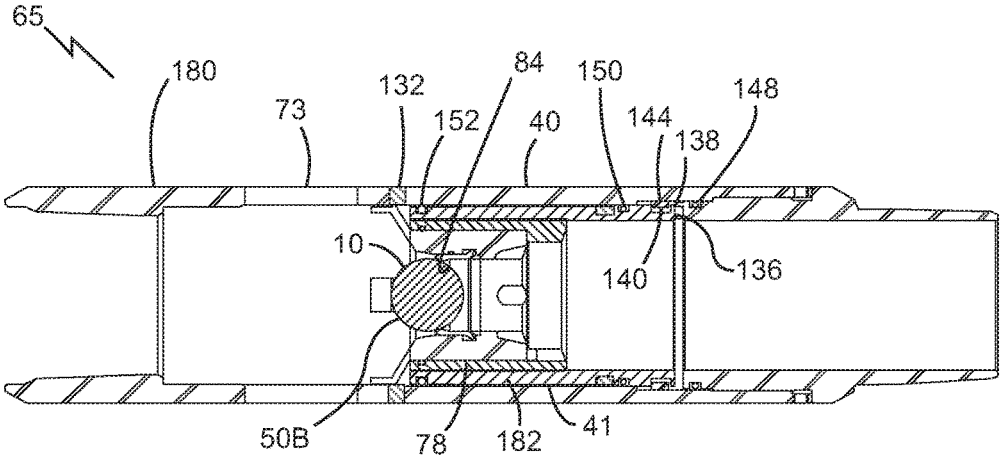

Referring to FIGS. 14-23 and 27-28 the downhole valve 54 may be incorporated into a fracturing sleeve 65. Referring to FIGS. 27-28, a fracturing sleeve 65 may operate as follows. A first drop plug 50A may be pumped down a well 44 (FIG. 14) through, and out a downhole end 76 of the downhole valve 54. If a compound seat such as sleeve part 86 is present, the drop plug 50A may actuate the sleeve part 86, for example by contacting first seat surface 82 in the first position to shift sleeve part 86 in the downhole direction (an intermediate position between the first and second positions is shown in FIG. 27), to form second seat surface 84 and move into the second position (shown in FIG. 28). Referring to FIG. 28, a second drop plug 50B is then pumped down the well 44 to seat the second drop plug 50B on the second seat surface 84 to close the downhole valve 54. The second drop plug 50B may have the same dimensions as the first drop plug 50A if a compound seat such as sleeve part 86 is used, and otherwise the second drop plug 50B will have a larger diameter than plug 50A.

Referring to FIG. 28, from the second position the downhole valve 54 may be closed by the second drop plug 50B, by pressurizing fluid in the well 44 to an extent sufficient to open a port 73 to an exterior 180 of the downhole valve 54. The port 73 may open by a suitable mechanism such as follows. In the example shown the inner mandrel 41 may be mounted to slide axially within the outer housing 40 to expose the port 73. Thus, when in the initial position an outer sleeve housing 182 of mandrel 41 blocks port 73. Housing 182 may mount housing 78, for example by a suitable method such as threaded connection. Opening of the port 73 may be initially restricted unless a pressure is applied above a predetermined threshold, such threshold being determined by a suitable mechanism such as pressure-rated shear pins 132 in correspondingly-shaped apertures 134. Once pins 132 are sheared as shown, pressure in the valve 54 slides the mandrel 41 in the downhole direction, with downhole travel limited in some cases by contact between an uphole facing stop surface 138 of the outer housing 40 and a downhole facing surface 136 of inner mandrel 41.

A suitable lock, such as the combination of a split ring 140 and corresponding recess 142 in sleeve housing 182, may be provided to lock the inner mandrel 41 in the position shown after port 73 is opened. Referring to FIGS. 27 and 28, a split ring 140 may be initially energized radially inward against a biasing force of the ring 140 to assume a compressed orientation within a recess 142 in sleeve housing 182, but as soon as downhole travel carries housing 182 to the point where recess 142 aligns with a recess 144 in the outer housing 40, ring 140 is permitted to radially expand to occupy parts of both recesses 142 and 144 to prevent further axial travel of sleeve housing 182. A rotational locking mechanism, such as a key 137 may be provided to engage part of outer housing 40, for example a key slot 139, in order to prevent relative rotation of inner mandrel 41 and outer housing 40 during drill or mill out.

Referring to FIG. 28, once seated and opened, fluid may be pumped down well 44 through the port 73 into the exterior 180 of the downhole valve 54, for example at or above a fracturing pressure of the formation, to treat the formation. Proppant or other treatment agents such as gel may be carried by the fluid into the formation as needed.

Once the fracturing operation is completed, the well 44 may be put under flow back or production, to permit fluids to flow in an uphole direction through valve 54. Referring to FIG. 9, flow back may act to unseat the second drop plug 50B and lodge the first drop plug 50A or a downhole object on the downhole valve 54, exposing a bypass 160 as discussed above with reference to FIG. 9 and other embodiments.

The compound seat, if present, may be configured to move into the second position under a sufficiently lower pressure, for example 500 psi or lower, than the pressure required to open the frac sleeve, in order to avoid prematurely opening the frac sleeve. In one example, the frac sleeve is set to shear open at 2500 psi, the compound seat is set to collapse inward (second seat surface 84—into the second position) at 1500 psi and release the ball on the ramp (first seat surface 82) at 1000 psi. Therefore, once the operator builds pressure to 1500 psi the seat surface 82 would collapse, the seat surface 84 would form, and the ball would be released nearly instantaneously.

Figure 14:
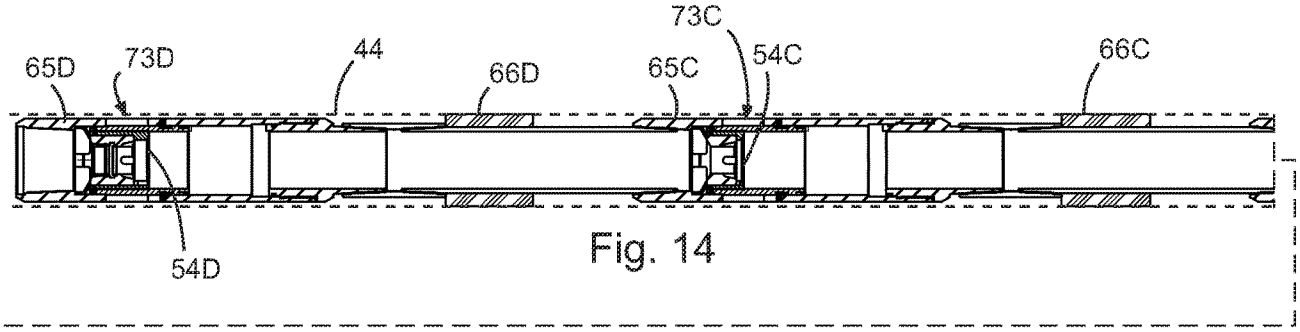
FIGS. 14-23 are side section views of a downhole tubing string mounting a plurality of downhole valves incorporated into frac sleeves, with the downhole valves alternating between downhole valves with and without a compound seat, and depicting a method of fracturing four zones in a formation using the frac sleeves, followed by flowing back the well to expose bypasses across each downhole valve.
Figure 15:
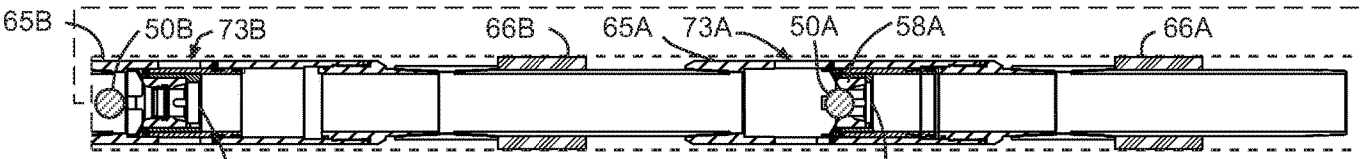
Figure 16:
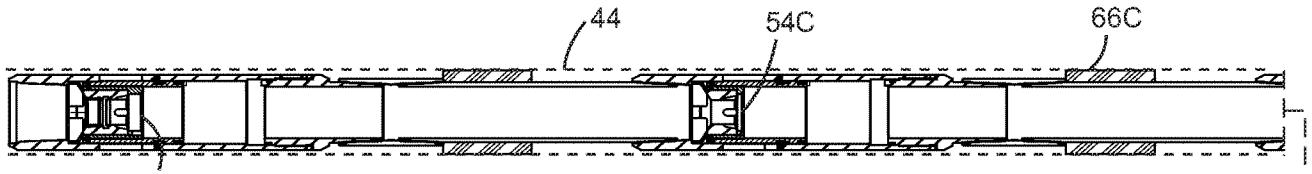

Referring to FIGS. 14-23, a series of views are provided to illustrate various stages of a multi-stage treatment operation incorporating downhole valves 54 incorporated within frac sleeves 65. Referring to FIGS. 14-15, the tubing string 190 shown in the well 44 incorporates a series of downhole valves 54 arranged in the following repeating pattern in the uphole direction: a) a packer 66, such as hydraulic packer 66A, actuated to seal off the annulus between the well 44 and tubing string 190, b) a downhole valve 54, such as valve 54A containing a compound seat, c) a second packer 66, such as packer 66B, actuated to seal off the annulus between the well 44 and tubing string 190, and d) a downhole valve 54, such as valve 54B, lacking a compound seat. The alternation of compound seat valves with non-compound seat valves doubles, for example to forty, eighty, or more, the number of fracturing zones that can be isolated along a well 44 relative to a given tubing string 190 that lacks compound seats.

Figure 17:
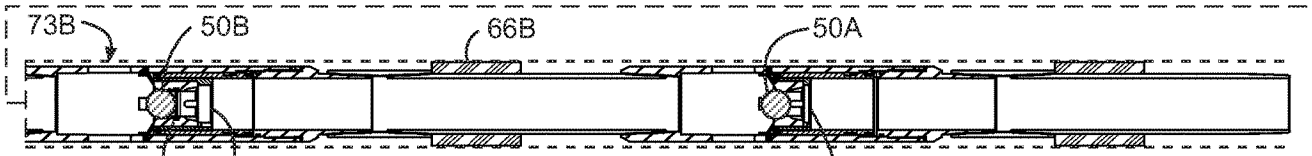
Figure 18:
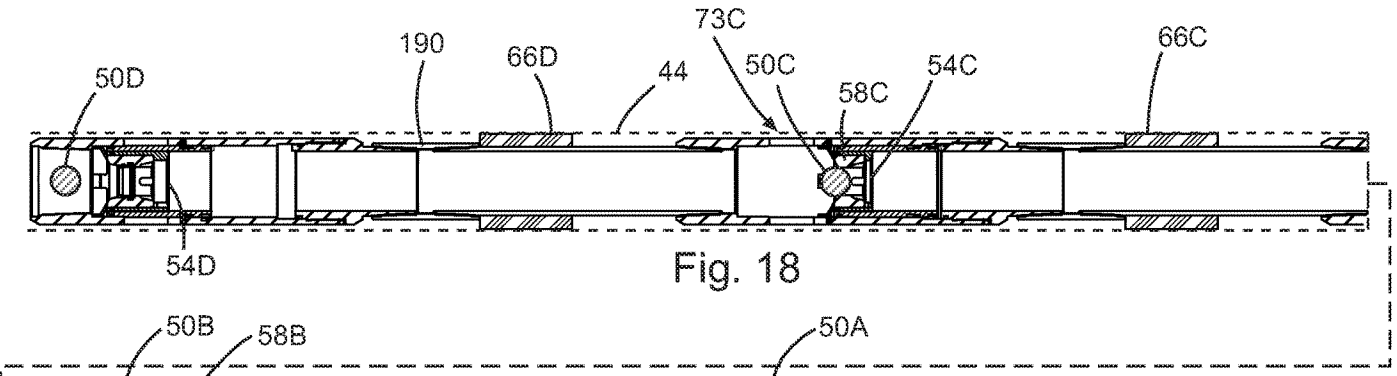
Figure 19:
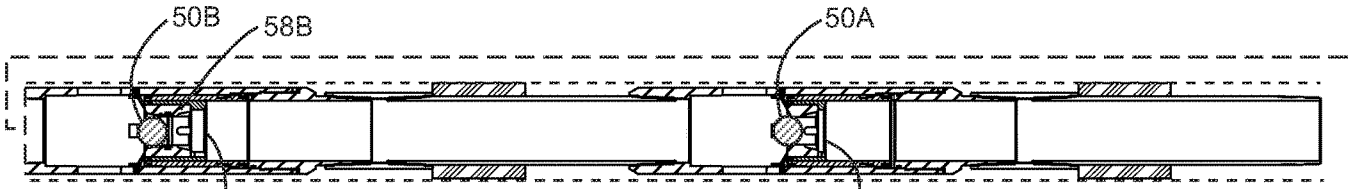
Figure 20:
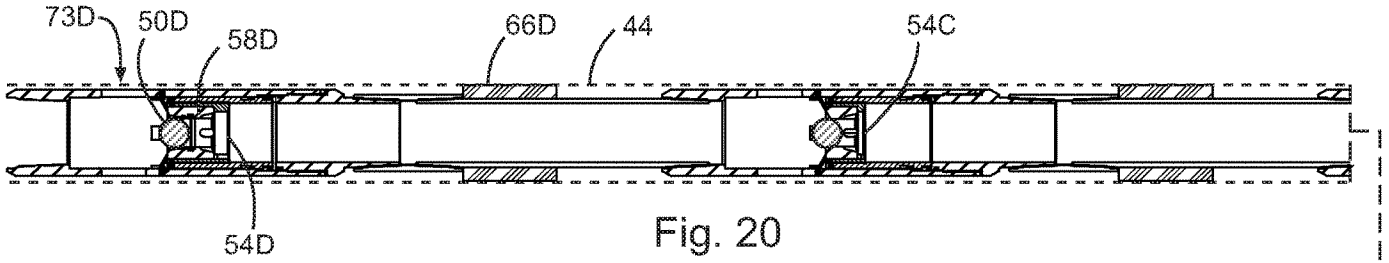
Figure 21:
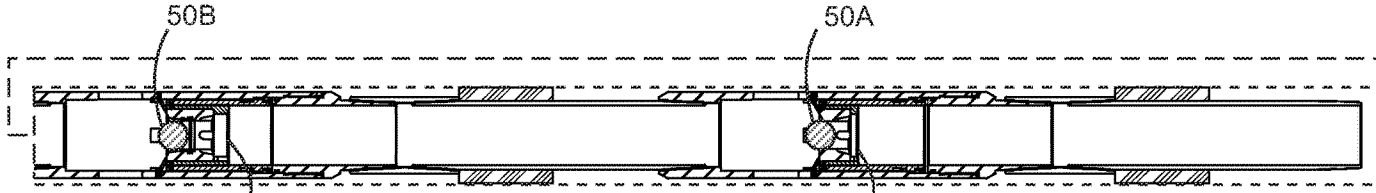
Figure 22:
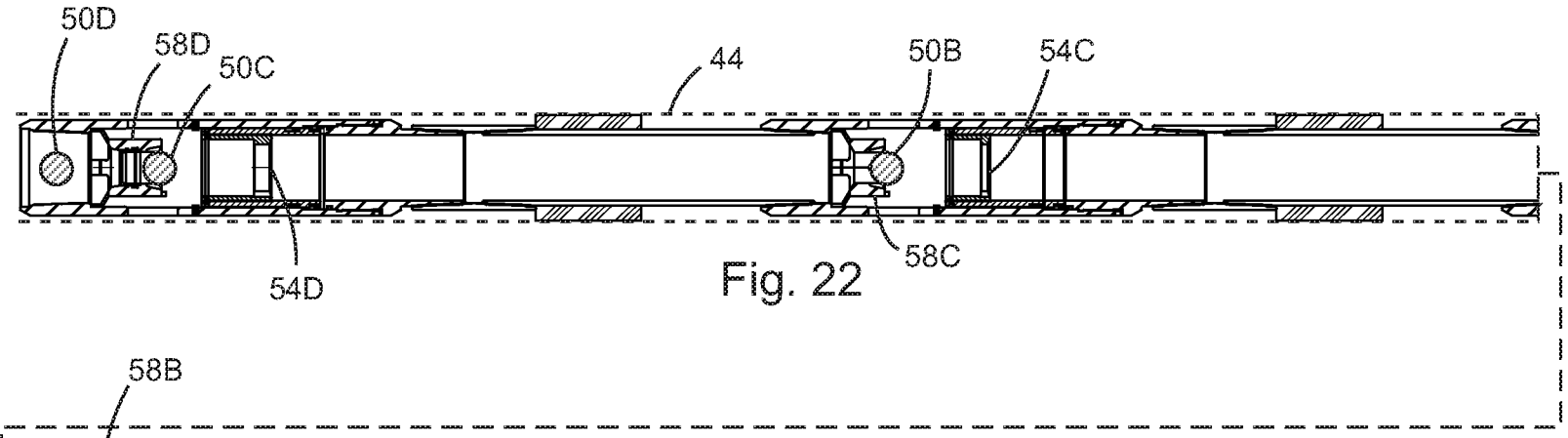
Figure 23:
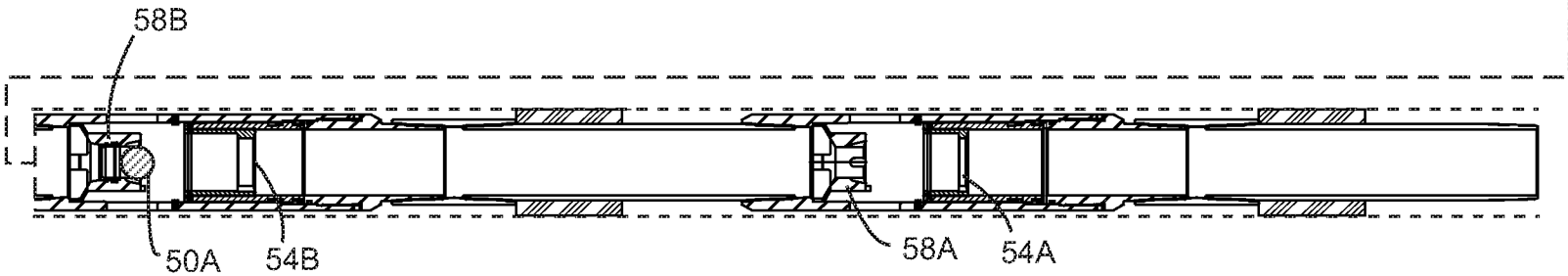

Operation of the embodiments of FIGS. 14-23 may proceed as follows. Referring to FIGS. 14-15, a drop plug 50A of a first size is pumped down the well 44 to seat upon valve 54A. The well 44 is pressured up to open port 73A in valve 54A, and the zone between packers 66A and 66B is fractured. Referring to FIG. 17, a drop plug 50B of the first size is then pumped down the well 44 to seat upon valve 54B, and the well pressured up to open port 73B and fracture the formation isolated between packers 66B and 66C. Referring to FIG. 18, a drop plug 50C of a second size larger than the first size is then pumped down the well 44 to seat upon valve 54C and pressurized to open port 73C and fracture the zone isolated between packers 66C and 66D. Referring to FIG. 20, a further drop plug 50D of the second size is then pumped downhole to seat upon valve 54D, and pressurized to open port 73D and fracture the zone isolated between an uphole packer (not shown) and the packer 66D. Referring to FIGS. 22 and 23, after the fracturing treatment is complete the flow is reversed in the well 44, unseating drop plugs 50A, B, C, and D, which are flowed to surface and collected. If, as in the example shown, drop plugs 50A, 50B, and 50C are deformed, for example into an egg-shape, and become lodged within valves 54B, 54C, and 54D, respectively as shown, the plural bypass paths across each such valve reduces pressure drop across each valve 54 and prevents flow restriction in the well 44. If desired, the valves 54 can be drilled or milled out, or retained in place as flow back is not restricted.

Locking Seats

Figure 33A:
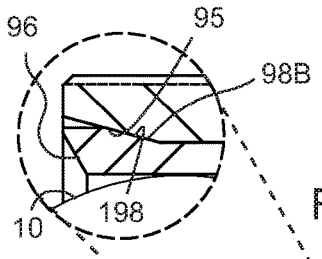
FIGS. 33A and 33B are section views of ramp and shoulder deflector embodiments for the area shown in dashed lines in FIG. 33.
Figure 33B:
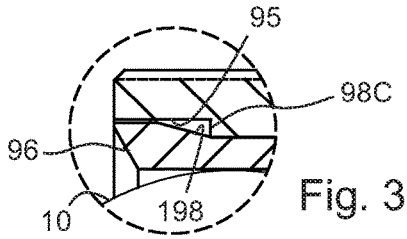
Figure 33:
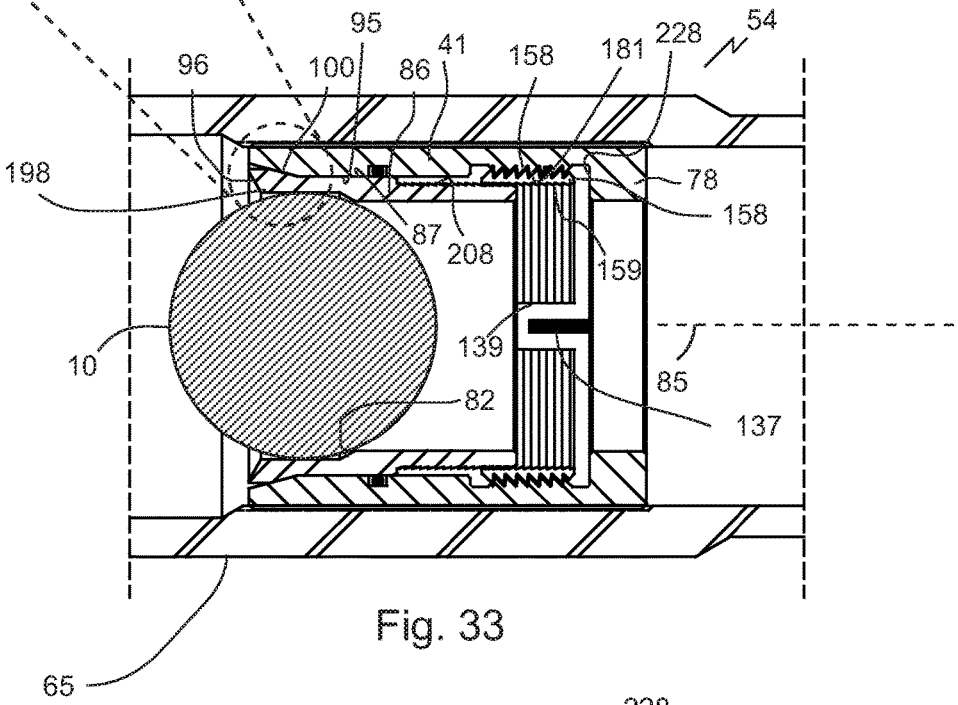
FIG. 33 is a section view of a downhole valve incorporating a locking seat that locks the ball from release in an uphole direction after seating, with a ratchet lock and with the inner mandrel mounted on an insert that is threaded into the outer housing.
Figure 34:
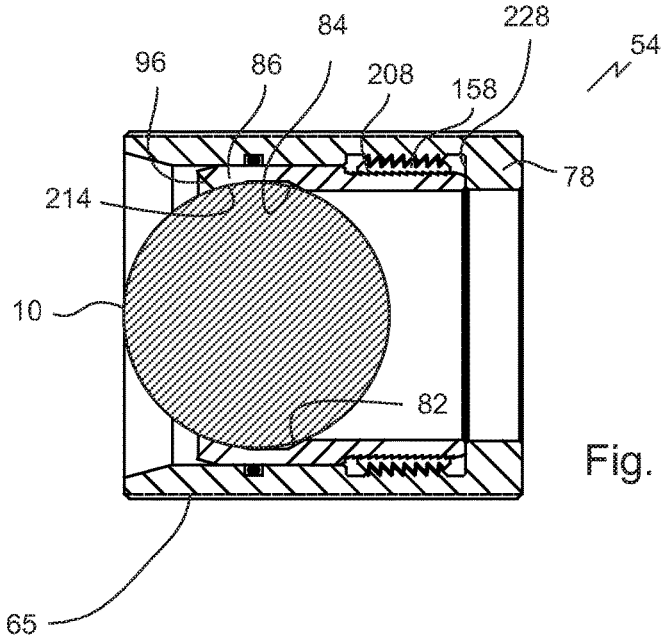
FIG. 34 is a section view of the locking seat of FIG. 33 actuated after the inner mandrel shifts into a second position, and with the outer tubing omitted.

Referring to FIGS. 33-45, embodiments of a downhole valve 54 are illustrated each with a locking seat for locking a drop plug between a downhole facing stop surface and an uphole facing drop plug seat surface. Referring to FIGS. 33-34, inner mandrel 41 may assume an initial or first position (FIG. 33) where the inner mandrel 41 is actuatable by a drop plug 10, to shift to a second position (FIG. 34) to form a downhole facing stop surface 214. Downhole facing stop surface 214 may lock drop plug 10 between the stop surface 214 and an uphole facing seat surface 84 of the downhole valve 54. One method of facilitating the shifting action is to use a sleeve part 86 mounted to shift along an axis 85 of the interior bore 83. When the inner mandrel 41 is in the first position, sleeve part 86 may form an uphole facing actuator surface, such as uphole facing drop plug seat surface 82. The seat surface 82 may encircle the interior passageway and be sized, or positioned, to receive the drop plug 10. As shown the seat surface 82 may form the uphole facing seat surface 84 after shifting to the second position.

Referring to FIGS. 33-34, a locking seat such as shown enables a user to pump the drop plug 10 downhole, seat the plug 10 on surface 84, increase pressure to shift the inner mandrel 41 into the second position, and lock the plug 10 in place in the downhole valve 54. The user is then free to put the well on standby for an extended period of time, even on production or flowback in some cases, with the confidence that the plug 10 will be retained in the valve 54 for future use. In a fracturing operation embodiment, after placement of plug 10 the well may rest for a period of several months or more prior to a fracturing operation being carried out, and in such a case the plug 10 remains in the valve 54 for use. By contrast, in a non-locking embodiment a drop plug 10 may be placed downhole and left, after which the plug 10 migrates uphole and becomes stuck in another part of the downhole tubing. In some cases it is impossible to re-seat a stuck plug 10 when desired to do so at a later time.

Figure 39:
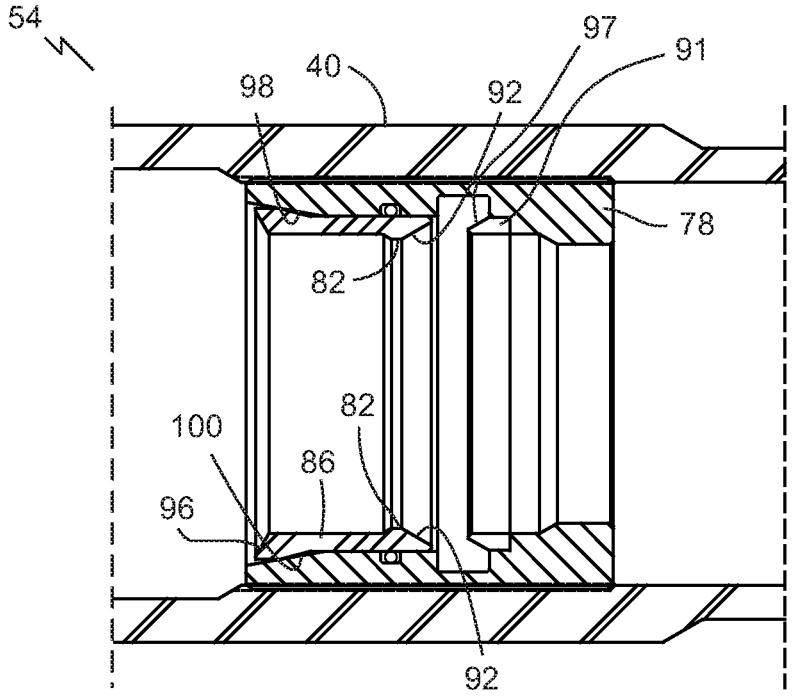
FIGS. 39-40 are side elevation views of a downhole valve with a locking seat and with an uphole facing actuator surface that is defeated on shifting from the first position (FIG. 39) to the second position (FIG. 40).
Figure 40:
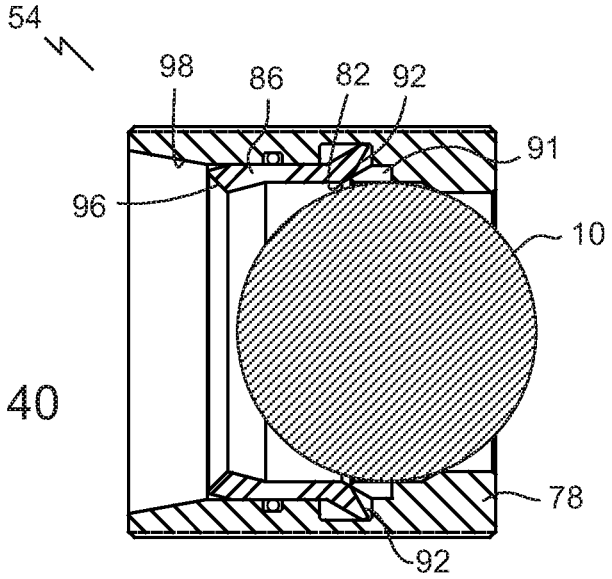
Figure 41:
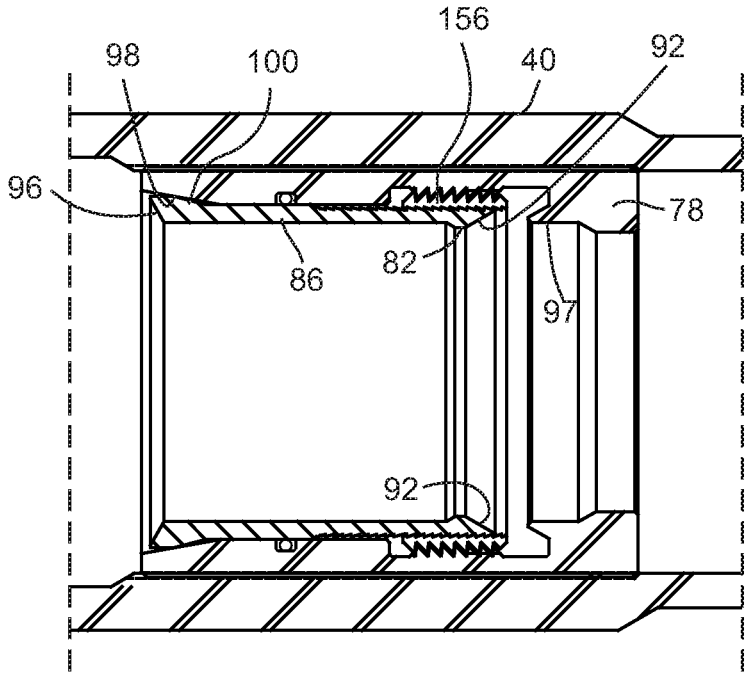
FIGS. 41-42 are side elevation views of another embodiment of a downhole valve with a locking seat and with an uphole facing actuator surface that is defeated on shifting from the first position (FIG. 39) to the second position (FIG. 40), and incorporating a ratchet lock.
Figure 42:
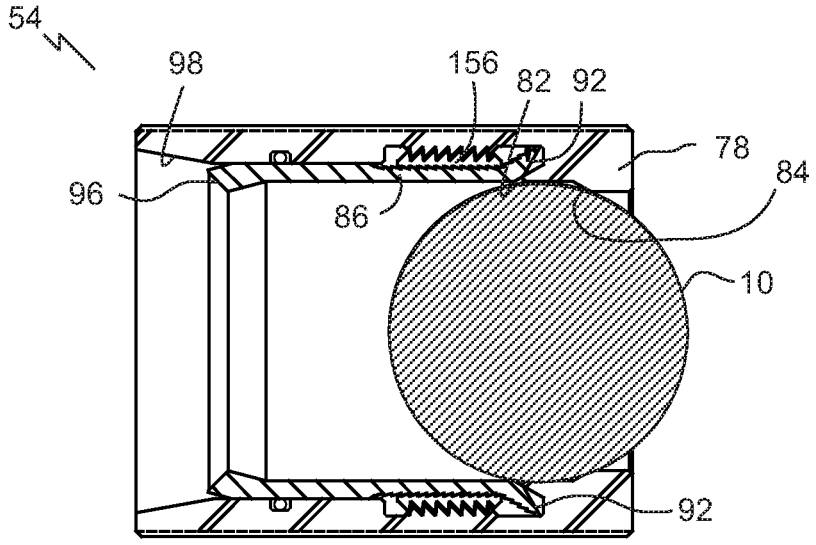

Referring to FIGS. 39-45, a first deflector part 97 may deform or defeat uphole facing actuator surface 82 in the process of shifting positions, in the same fashion as the compound seat discussed elsewhere in this document. Referring to FIGS. 39-40, in the first position (FIG. 39), and in some cases while moving into the second position (FIG. 40), a first deflector part, for example ring 91, may stand in the path of a downhole facing surface, such as nose ramp 92, of the sleeve part 86. Deflector part 97 may be structured to contact, during actuation, a downhole facing surface of the sleeve part 86. One or both the first deflector part 97 or a downhole portion, such as nose ramp 92, of an outer wall of the sleeve part 86 may be sloped to cooperate to push the sleeve part 86 radially outward when the inner mandrel 41 is moving from the first position to the second position. An uphole facing surface 90 of ring 91 may be sloped radially outward with increasing distance from the nose ramp 92. The downhole facing surface, such as nose ramp 92, may be sloped radially inward with increasing distance from the ring 91.

Referring to FIGS. 39-42, in some cases, defeating actuator surface 82 permits drop plug 10 to move further downhole to an uphole facing seat surface 84. In other cases ring 91 defines seat surface 84. Uphole facing drop plug seat surface 84 may be located, at least in the first position, in a downhole direction from the first deflector part 97. Referring to FIG. 33, in other cases, the uphole facing actuator surface is the uphole facing seat surface 84.

Referring to FIGS. 33-34, the inner mandrel 41 may be actuated to form the downhole facing drop plug stop surface 214. A second deflector part 100, such as a restriction for example a ramp part 98B (FIG. 33A) or a shelf 98C (FIG. 33B), of wall surface 95 of inner mandrel 41, may stand in the path to bend the sleeve part 86, such as an uphole portion 198, for example a flared tail ramp, radially inward to form the stop surface 214. The locking seat may be made of ductile material to facilitate bending without cracking. One or both the second deflector part 100 or the uphole portion 198 of the sleeve part 86 may be sloped to cooperate to push the sleeve part 86 radially inward when the inner mandrel 41 is moving from the first position to the second position. Second deflector part 100 may be sloped radially inward with increasing distance from portion 198 of the outer wall of the sleeve part 86, and the uphole portion 198 may be sloped radially inward with decreasing distance from the second deflector part 100. Second deflector part 100 may comprise a cylindrical inner wall surface 95 that encircles the outer wall 87 of the sleeve part 86. Second deflector part 100 may narrow radially inward to the cylindrical inner wall in the downhole direction. Outer wall 87 may conform to the shape of the cylindrical inner wall surface 95 along an axial direction when the inner mandrel 84 is in the second position. The downhole facing drop plug stop surface 214 may be defined on or adjacent a free uphole end of the sleeve part 86.

Referring to FIGS. 33-34, and 37-38, downhole valve 54 may comprise a locking part, such as ratchet, that restricts, for example prevents, inner mandrel 41 from moving from the second position to the first position. Referring to FIGS. 33-34, the locking part may comprise a ratcheting ring 158 with teeth 159 that engage with complimentarily shaped teeth 208 on sleeve part 86 to permit one-way sliding movement between the two sets of teeth. Ring 158 may have teeth 181 on an outer surface that engage with corresponding teeth 156 on inner mandrel 41 or the outer housing ring. A rotational locking or anti-rotation mechanism, such as a pin or key 137 may be provided to engage part of inner mandrel 41, for example a key slot 139, in order to prevent relative rotation of inner mandrel 41 and outer housing 40 during drill or mill out.

Figure 37A:
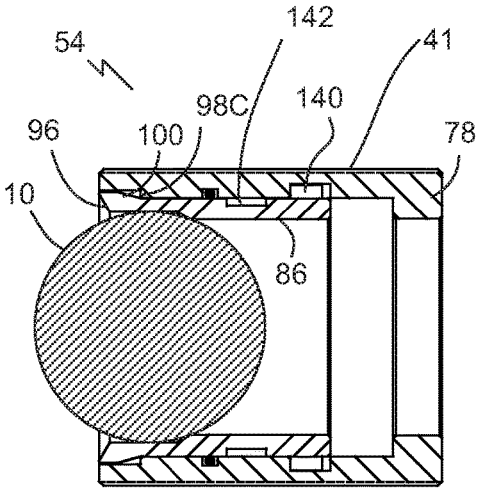
FIGS. 37A-B are side elevation views of a housing insert for a downhole valve incorporating a locking seat and a split ring that is energized to contract to lock the inner mandrel in place after moving from the first position (FIG. 37A) to the second position (FIG. 37B).
Figure 37B:
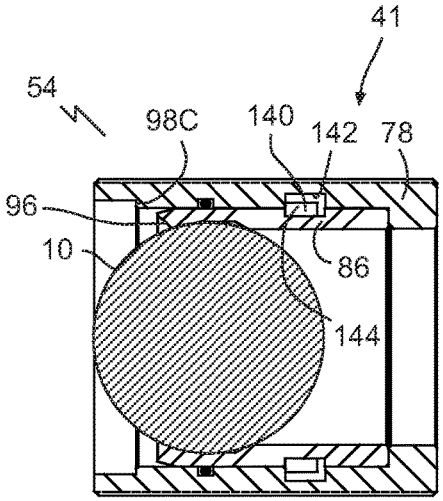
Figure 38A:
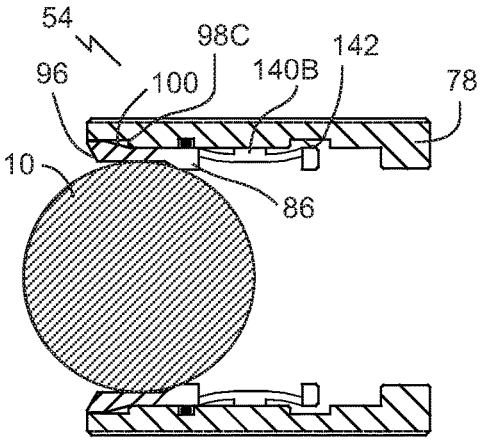
FIGS. 38A-B are side elevation views of an insert for a downhole valve incorporating a locking seat and a split ring that is energized to expand to lock the inner mandrel in place after moving from the first position (FIG. 38A) to the second position (FIG. 38B).
Figure 38B:
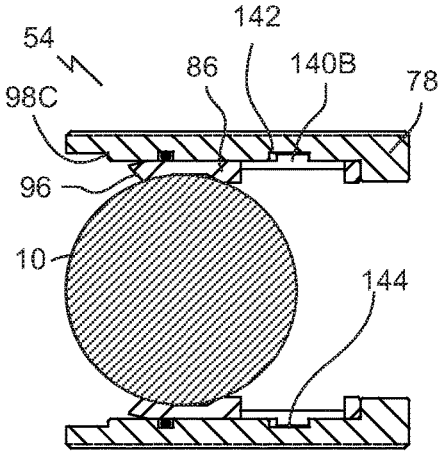

Referring to FIG. 37A-B a suitable locking part may be provided. One example of a locking part is a contracting full or split ring 140, for example a split ring that may be initially energized radially outward against a biasing force of the ring 140 to assume an expanded orientation within a recess 142 in inner mandrel 41 or outer housing, but as soon as downhole travel carries sleeve part 86 to the point where recess 142 aligns with a recess 144 in the inner mandrel 41, ring 140 is permitted to radially contract to occupy parts of both recesses 142 and 144 to prevent further axial travel of sleeve housing 182. A split ring includes a C-ring or snap ring. Referring to FIGS. 38A-B, another example includes an expanding full or split ring 140B, for example a split ring that may be initially energized radially inward against a biasing force of the ring 140B to assume an expanded orientation within a recess 142 in inner mandrel 41 or outer housing, but as soon as downhole travel carries sleeve part 86 to the point where recess 142 aligns with a recess 144 in the inner mandrel or outer housing, ring 140 is permitted to radially expand to occupy parts of both recesses 142 and 144 to prevent further axial travel of sleeve housing 182.

Figure 36:
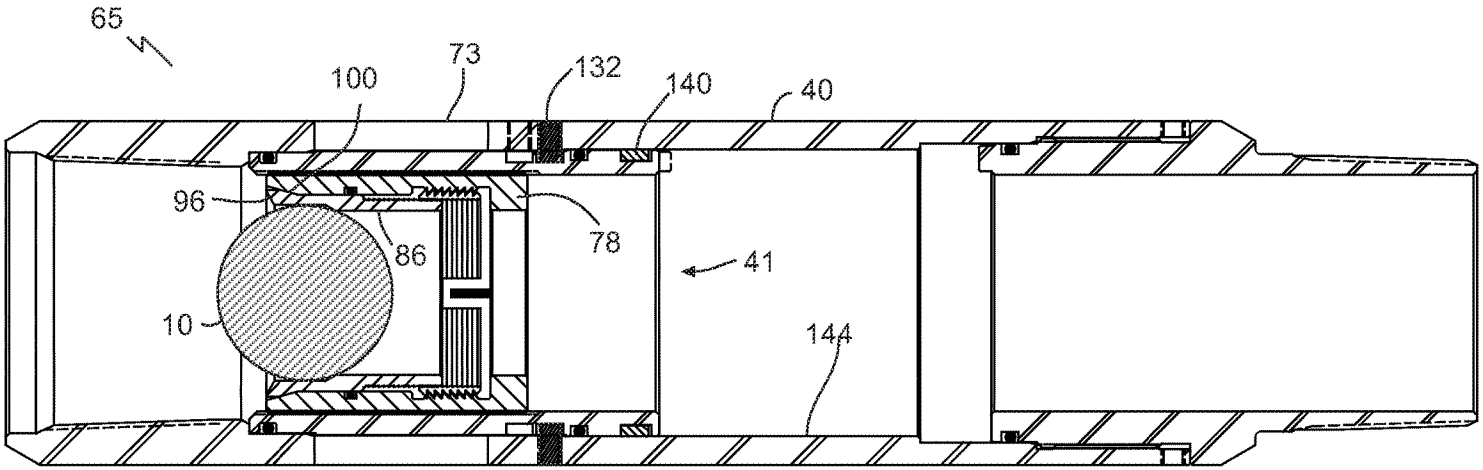
FIG. 36 is a section view of a locking seat embodiment in a frac sleeve.

Referring to FIG. 36, the downhole valve 54 may be incorporated into a fracturing sleeve 65. The fracturing sleeve 65 may operate as follows. Drop plug 10 may be pumped down a well into an interior bore 22 of a downhole valve 54 to actuate the downhole valve 54. Actuating valve 54 may form a downhole facing stop surface (not shown) that locks the drop plug 10 and close valve 54. Fluid may be pressurized in the well to an extent sufficient to open a port 73 to an exterior of the downhole valve 54, for example by shearing a shear pin 132. Fluid may be pumped through the port 73 into the exterior of the downhole valve 54 at or above a fracturing pressure of the formation. An expanding ring 140 may engage recess 144 in the second position to lock the mandrel 41 in place after the shift.

Figure 35:
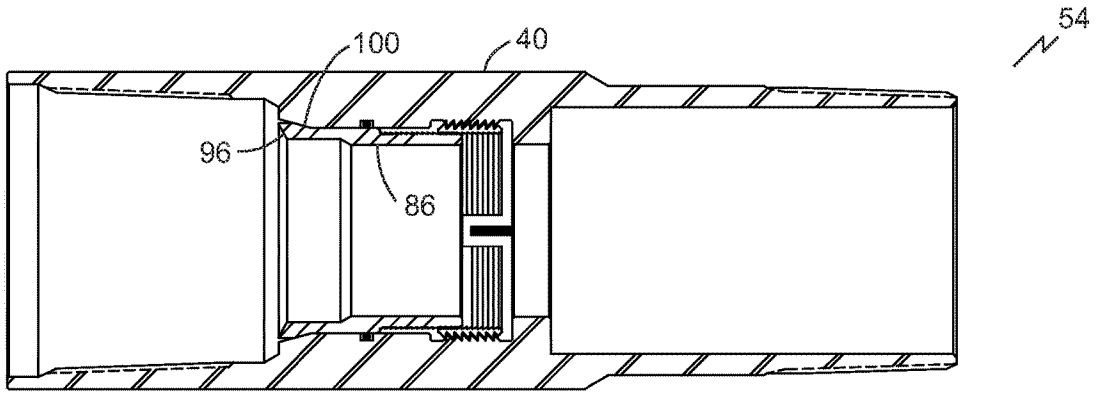
FIG. 35 is a section view of a further embodiment of a locking seat with the inner mandrel mounted directly to the outer housing.
Figure 43:
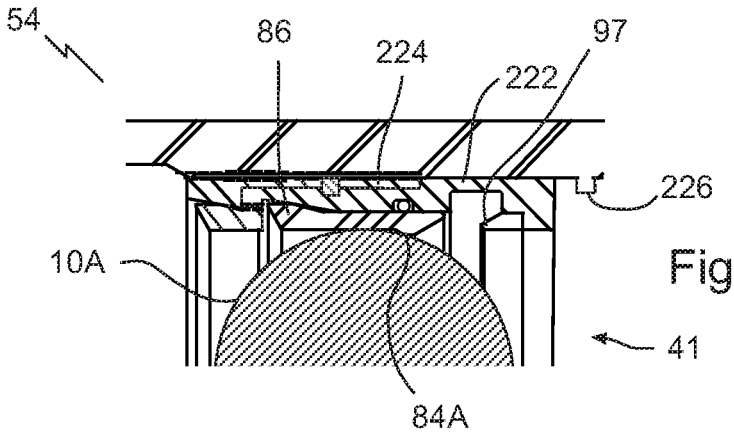
FIGS. 43-45 are a sequence of section views of an embodiment of a downhole valve that incorporates both a locking seat and a compound seat. The figures illustrate a method of using the downhole valve to pass a first ball downhole (FIG. 43) while seating a second ball (FIGS. 44-45) with the same dimensions as the first ball.
Figure 44:
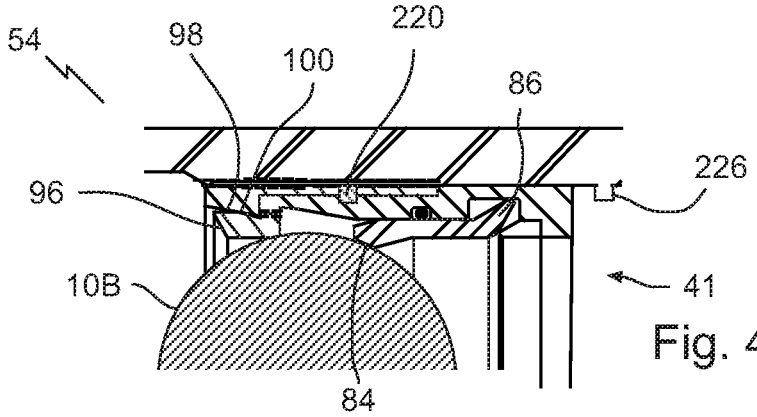
Figure 45:
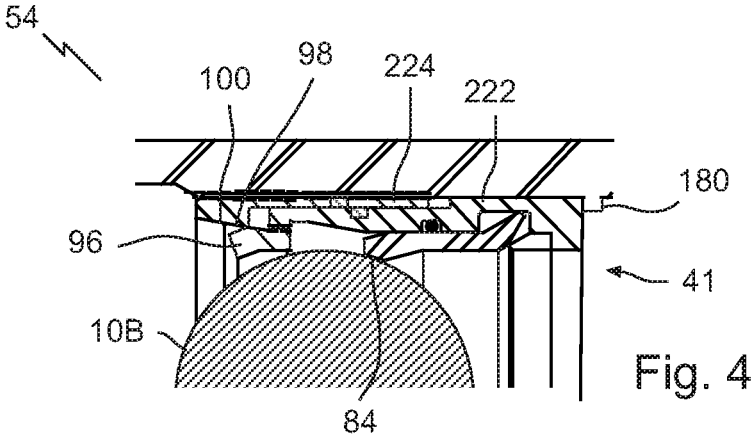

Other forms of locking seats may be used. For example, FIG. 35 illustrates a version where the sleeve part 86 mounts directly to the outer housing 40. Referring to FIGS. 43-45, a version is illustrated incorporating a compound seat and a locking seat. Thus, a first ball 10A contacts actuator surface 84A and actuates the sleeve part 86 to shift from a first position (FIG. 43) to a second position (FIG. 44), and continues on down the well to seat at a valve located further downhole. Next, a second ball 10B of same size as ball 10A contacts actuator surface 84B (FIG. 44) and causes mandrel 41, or part of mandrel 41 such as a further sleeve part as shown, to shift to a third position (FIG. 45). In moving to the third position a free uphole end 96 or another suitable part of sleeve part 86 or mandrel 41 is bent radially inward to form a downhole facing drop plug stop surface (FIG. 45) to lock the second ball 10B in place. In moving from the second to third position, part 222 of the sleeve part 86 moves relative to a part 224 of the inner mandrel 41 or outer housing. Downhole movement of part 222 may be restricted by a stop, such as stop shoulder 226. The locking seat, for example mandrel 41, may be drilled out after completion of use of the valve 54.

Dissolvable Plugs

Referring to FIGS. 29-32, a downhole drop plug 10 may comprise a dissolvable part, such as a core 154 and a metal part, for example an outer metal part, such as a shell 152. Core 154 is one example of a first part that comprises a first metal that dissolves in the presence of an electrolyte. Some examples of suitable core metals include magnesium (Mg), chromium (Cr), tin (Sn), aluminum (Al), zinc (Zn), and others, with the core metals provided as alloys, such as a magnesium alloy, or in pure form. Outer metal shell 152 may be in electrical contact with core 154 by a suitable means such as physical contact or across another conductive medium. Shell 152 is one example of a second part that comprises a second metal that may accelerate the rate of dissolution of the first metal when the first metal and second metal are exposed to the electrolyte through a suitable process such as galvanic corrosion. The two metals may effectively form a battery. An outer metal shell 152 may form a conductive plate that creates or enhances a galvanic reaction. In some cases the outer metal part may be localized, for example to form a conductive mass, in a specific area of the ball less than a full exterior coverage of the mandrel, in electrical contact, for example in direct contact, with core 154.

Galvanic corrosion (also called bimetallic corrosion or contact corrosion) is an electrochemical process in which one metal corrodes preferentially to another when both metals are in electrical contact, in the presence of an electrolyte. The shell 152 may have a lower anodic index than the core 154 and the shell 152 acts as a cathode. Suitable metals for the outer shell 152 may include one or more of copper, silver, nickel and others. A higher anodic index for a metal may indicate a higher anodic tendency when used in a galvanic cell. For the shell 152 and the core 154, the difference in anodic index may be greater than 0.15 volts to facilitate corrosion. A non-metal may coat the outer metal shell 152, for example if a polymeric coating is used, for example made of thermal plastic such as PTFE.

Figure 29:
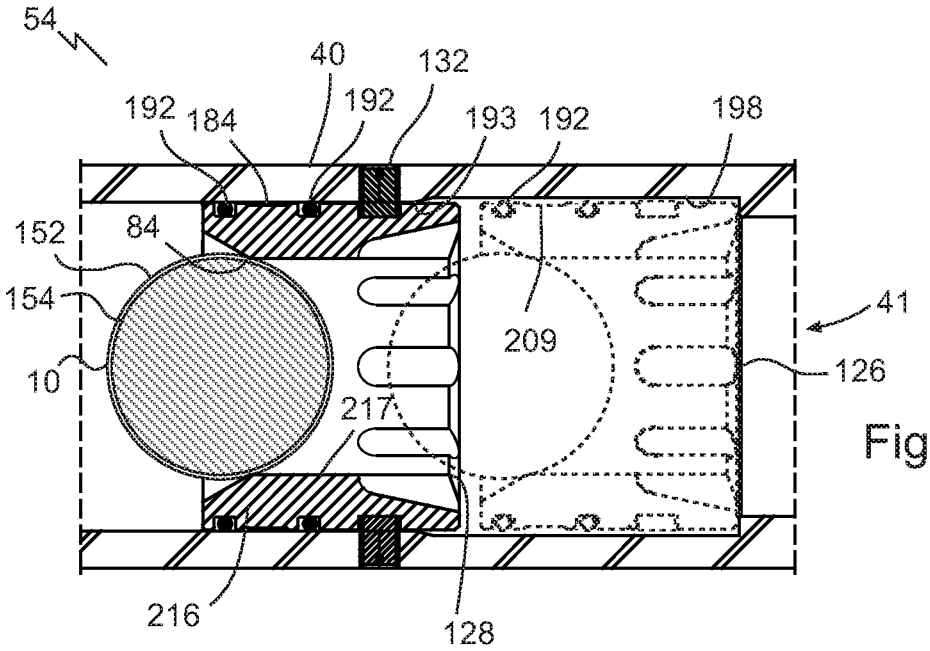
FIG. 29 is a section view of a further embodiment of a downhole valve with a dissolvable seat (inner mandrel) lined with a protective outer coating, and seating a ball that has a dissolvable core and a protective outer coating. The downhole valve is actuatable under pressure to shift to a second position shown in dashed lines.

Referring to FIGS. 25 and 29-32, a suitable mechanism may be used to expose the core 154 to the electrolyte solution to begin dissolution. Referring to FIG. 29, the outer metal shell 152 may fully enclose core 154 and be impermeable to fluids, such as brine or acid, to prevent corrosion of core 154. In such cases, the shell 152 may be structured to become damaged during use or during downhole travel, to expose the core 154. In some cases, shell 152 may be covered by a thin layer of a suitable material, such as copper, that is mechanically removable, for example by deforming or scratching, prior to dropping into valve 54, when drop plug 10 strikes a downhole surface such as a seat defined by inner mandrel 41, or when the drop plug 10 is put into contact with abrasive materials such as proppant.

Referring to FIG. 25, in some cases, core 154 is already exposed when ball 10 is introduced into the well. Shell 152 may define openings, such as a window or opening 150, to expose core 154 to an exterior of the outer metal shell 152 and permit corrosion. Referring to FIG. 29, in some cases perforations or openings may be provided on the shell 152 that are too small to see with the naked unaided eye but that are large enough to leak electrolytes to the core 154. The outer metal shell 152 may be plated, for example electroplated to the core 154. Electroplating may include electroless plating in some cases, such as nickel-plating. Electroless plating is also known as chemical or auto-catalytic plating, and includes non-galvanic plating methods that involve several simultaneous reactions in an aqueous solution, which occur without the use of external electrical power. The extent and thickness of the plating may be controlled to provide reproducible and consistent micro perforations in the shell 152. Corrosion of plug 10 may also be controlled by one or more of pumping the plug 10 downhole, or storing the plug 10 in a downhole position while immersed in a non-electrolytic solution such as fresh water or oil. When it is desired to corrode the core 154, a suitable electrolyte solution such as acid or brine may then be pumped into contact with the plug 10 to corrode the core 154. Outer metal shell 152 may have a suitable thickness to facilitate puncturing and/or perforations, such as by having a thickness of 0.0050" or less, such as 0.0020", 0.0015", 0.0010" or less. In some cases the thickness is between 0.0020" and 0.0050".

Referring to FIGS. 29-32, drop plug 10 may be structured to seat on a downhole valve 54, and shell 152 may be structured to expose the core 154 during use. For example, the shell 152 may expose the core 154 upon contacting the downhole valve 54, for example by a physical impact, such as scratching or denting, on a part of the downhole valve 54, such as an edge of the valve seat. The shell 152 may be damaged by pressuring up against the valve seat, for example to damage or deform outer shell 152. A puncturing part such as teeth, a pin or in some cases an edge of the valve seat, may be positioned on the valve seat to selectively damage the shell 152. In some cases, drop plug 10 is exposed to abrasive proppant materials while seated on or adjacent the downhole valve 54 to wear off parts or all of the shell 152. In one case a downhole plug 10 is placed downhole on a valve upstream of a toe sleeve, the toe sleeve is opened, abrasive proppant is pumped down the well into the formation, and the shell 152 is completely or partially abraded to initiate corrosion of the core 154. Scratching, denting, deforming or other mechanisms of exposing the core 154 to electrolytes and thereby facilitating galvanic corrosion may be used. In some cases, shell 152 may not dissolve in the presence of the electrolyte.

Figure 25A:
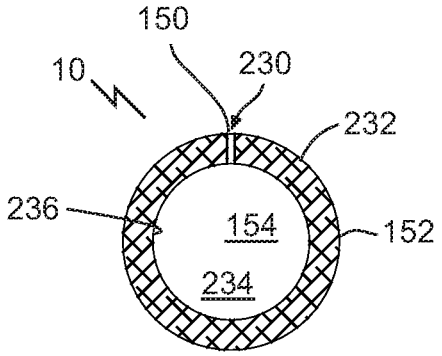
FIG. 25A is a cross-section of a hollow embodiment of a dissolvable drop plug.

The core of the drop plug 10 may have a suitable structure. Referring to FIG. 25, the drop plug 10 may have a solid core. A solid core may be understood as being not hollow or containing spaces or gaps. Referring to FIG. 25A, drop plug 10 may define a fluid passageway 230, such as a channel or plurality of channels, that extend from an outer surface 232 of drop plug 10. The metal of the core may form a shell 236. Fluid passageway 230 may extend from exterior surface 232 of shell 236. The exterior surface 232 of shell 236 may be coated, for example nickel or copper plated, with a suitable protective coating. In an initial configuration, the passageway 230 may be covered by the protective coating although in other cases the passageway 230 extends also through the outer metal shell 152 to define an opening 150 for direct access to core 154 by wellbore fluids.

Referring to FIG. 25A, passageway 230 may permit a fluid, such as electrolytic fluid, to flow into core 154, increasing the surface area of the metal of the core that contacts the fluid. In some cases passageway 230 accelerates the dissolution of the metal of core 154, for example by up to five times or more relative to an embodiment lacking a passageway 230. Core 154 and outer metal shell 152 may be in electrical contact for galvanic corrosion to occur. The metal of core 154 may form shell 236 as an inner metal shell within outer metal shell 152, and may provide a spherical surface for contact with the electrolytic fluid. In some cases, shell 236 defines a hollow internal portion 234, for example a spherical hollow portion as shown, that may act to reduce the mass of drop plug 10 and the amount of time required to dissolve drop plug 10. Hollow internal portion 234 may increase the surface area and exposure of shell 152 to electrolytic fluid through passageway 230.

Figure 25B:
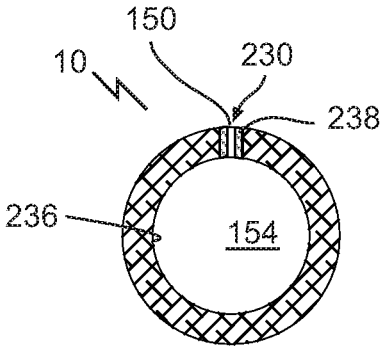
FIG. 25B is a cross-section of a hollow embodiment of a dissolvable drop plug, with a conductive sleeve lining a port to the hollow interior.

Referring to FIG. 25B, passageway 230 may be lined by a sleeve 238. Sleeve 238 may form a conductive metal insert, for example a conductive plating, such as copper. Sleeve 238 may act as a cathode when in electrical contact with a suitable anode, for example core 154 or shell 236. In some cases, frac ball 10 has a non-conductive outer shell and a conductive sleeve 238. A protective coating on shell 152 may be provided on the ball 10. Plug 10 with sleeve 238 may be launched in a salt water environment. The sleeve 238 and core 154 may react in the salt water solution to rapidly dissolve plug 10 on two surfaces, such as two spherical surfaces. In cases where a hollow plug 10 is used, plug 10 will have less mass to dissolve than a solid plug 10.

Figure 25C:
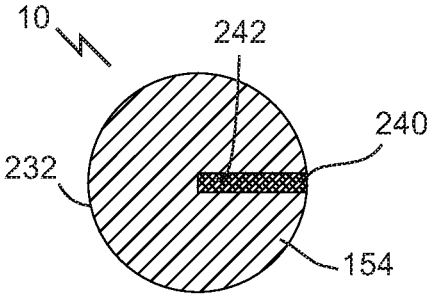
FIG. 25C is a cross-section of an embodiment of a dissolvable drop plug with a conductive rod or pin.

Referring to FIG. 25C, drop plug 10 may comprise a second part, for example rod 240, with a suitable second metal, such as copper, that is in electrical contact with the first part, for example core 154, with a suitable first metal, such as magnesium. Rod 240 may act as a cathode when in electrical contact with a suitable anode, for example core 154. Rod 240 may be inserted or formed within an internal cavity 242 defined by core 154. Rod 240 may extend partially into the core 154 from exterior surface 232, and in other cases may extend from one side of the core 154 through to an opposing side of the core 154. Rod 240 may be secured to core 154 by a suitable method, such as a threaded connection, welding, an interference fit, and others.

Dissolvable Seats

Referring to FIGS. 29-32, inner mandrel 41 may be made in whole or in part with dissolvable material 216, for example material that dissolves in the presence of an electrolyte. The ability to dissolve part or all of inner mandrel 41 may be advantageous because such may reduce obstruction in the interior bore, thereby reducing, eliminating, or simplifying, the need to drill out the valve after completion of the frac or other downhole operation. In some cases dissolution may be timed by controlling the exposure of the dissolvable material, such that the inner mandrel 41 remains intact until the user desires to expose the mandrel 41 to corrosion, such as after a frac operation is carried out.

Referring to FIGS. 29-32, inner mandrel 41 may comprise a protective coating 217 that limits or prevents undesired exposure of an inner core of dissolvable material 216 to conditions that may dissolve inner mandrel 41. Protective coating 217 may cover the dissolvable material 216 either wholly or in part. Coating 217 may comprise a suitable non-metal, such as Teflon or a suitable metal, such as copper, nickel, silver or others, including alloys. Metal coatings 217 may be electroplated onto the mandrel 41, for example using electroless plating, over the dissolvable material 216, for example to a thickness of 0.0050" or less, such as 0.002" or less, or 0.0005" or less.

Coating 217 may assist in protecting the dissolvable material 216 and/or aiding in galvanic corrosion of the dissolvable material. The dissolvable material 216 may comprise a first metal that dissolves in the presence of an electrolyte and the protective coating 217 may comprise a second metal that is in electrical contact with the dissolvable material 216. A protective metal coating may accelerate the rate of dissolution of the dissolvable material 216 when both of the material 216 and coating 217 are exposed to the electrolyte. In some cases, the whole of inner mandrel 41 comprises dissolvable material 216, such as magnesium, and a thin knife edge protective coating, such as nickel, covers the entire surface of mandrel 41, or in some case covers at least the parts of the mandrel 41 that are exposed to fluids in the interior bore when the valve 54 is in the first or intermediate position. The second metal may form a conductive plate that creates or enhances a galvanic reaction with the first metal. In some cases the second metal may be localized, for example to form a conductive mass, in a specific area of the mandrel 41 less than a full exterior coverage of the mandrel, in electrical contact, for example in direct contact, with the first metal.

A non-metal may be used as a protective coating 217. For example, a polymeric material such as a thermal plastic, for example PTFE, may coat the inner mandrel or valve seat. In some cases the non-metal, such as PTFE, may coat and protect the second metal, such as plated copper or nickel, which may form a protective coating itself. A non-metal coating may be used to make a permeable metal coating at least temporarily impermeable. The protective coating or plating may be nickel in some cases or one or more of a multitude of plastic type coatings such as PTFE.

A removable protective coating 217 may also be used. A removable protective coating 217 may be selectively removed, for example by puncturing or abrading to expose the dissolvable material 216 to dissolve, for example after the valve 54 has served its desired downhole purpose. The coating 217 may be removed on exposure to contact with an abrasive, such as a proppant or downhole drop plug 10. For example, in a fracturing operation a toe sleeve in the tubing string may be opened, and proppant-laden fluid, such as sand entrained in gelled water or hydrocarbons, may be pumped into the formation. The proppant-laden fluid may abrade the coating 217 or parts of it, exposing the dissolvable material 216 to internal and/or external wellbore fluids. If an electrolyte is present, the material 216 may start to dissolve. In some cases non-corrosive fluids are pumped into the interior bore during the frac, for example fresh water or hydrocarbon frac fluid to immerse the mandrel 41, and after the frac, brine or acid is pumped into contact with mandrel 41 to facilitate dissolution. In other cases, no non-corrosive fluid is used to protect the exposed mandrel 41, as the frac, which may take several days to complete, may be completed before substantive dissolution of the mandrel 41, which by contrast may take months.

Figure 31:
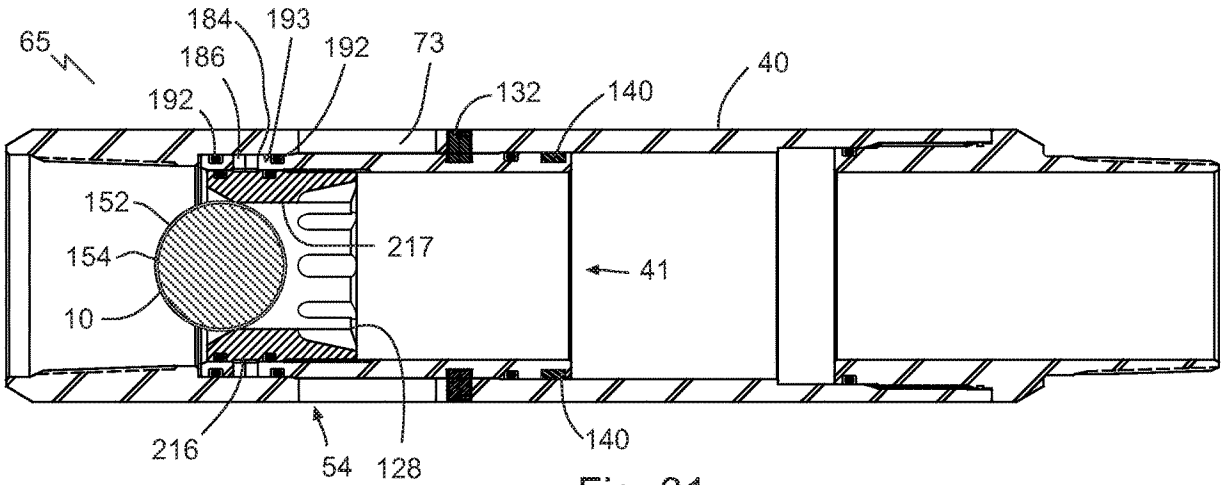
FIGS. 31 and 32 are section views of an embodiment of a frac sleeve seating the ball of FIG. 29, and incorporating a dissolvable seat with a protective outer coating.
Figure 32:
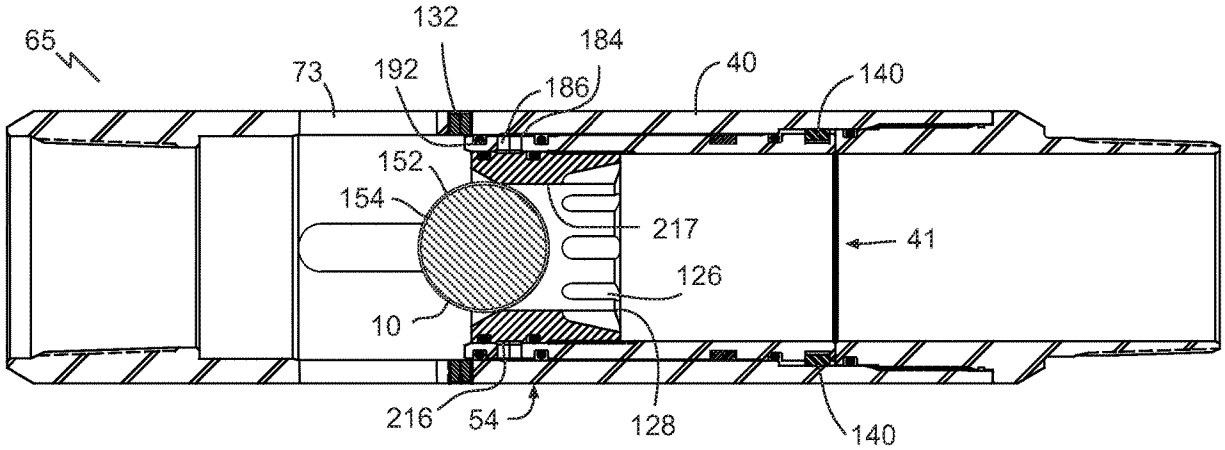

Referring to FIGS. 29 and 31-32, inner mandrel 41 may be actuatable to selectively expose dissolvable material 216. Referring to FIG. 29, inner mandrel 41 may have a first position (shown in solid lines) where actuation by a drop plug 10 may shift the inner mandrel 41 to a second position (shown in dashed lines) where the dissolvable material 216 becomes exposed. Exposure may include exposing the dissolvable material to one or more of wellbore fluids, fluids within the interior passageway (shown), abrasive proppant and others.

Referring to FIG. 29, in the example shown, an outer wall surface portion 184 of the inner mandrel 41 is protected in the first position and exposed in the second position. The dissolvable material 216 may be located on, or in fluid communication with, the outer wall surface portion 184 and may be sealed, for example between o-ring seals 192, within an inner restriction surface 193 in the outer housing 40 or in a housing of the mandrel 41 while in the first position. The exposed wall surface portion 184 may be formed by coating the entire external surface of mandrel 41, and then machining out an annular groove in the mandrel 41 to expose the dissolvable material 216. Upon actuation, outer wall surface portion 184 may slide out of contact with the restriction surface 193 and into a region of the outer housing 40, for example a relatively wider diameter section as shown, to expose the dissolvable material 216 to interior bore fluids, for example through an annular gap 209 between the surface portion 184 and the surface portion 198. Referring to FIGS. 31-32, dissolvable material 216 may be in fluid communication with the outer wall surface portion 184 via a port 186 in the outer wall surface portion 184.

Referring to FIGS. 31-32, in some cases, the downhole valve 54 is actuatable to open, for example via port 186, to the exterior surface of the outer housing 40. In some cases, actuation is achieved with pressurization above a predetermined pressure, which is set by a suitable mechanism such as pressure-rated shear pins 132. Once pins 132 are sheared, the mandrel 41 slides in the downhole direction, with downhole travel limited in some cases by contact between an uphole facing stop surface of the outer housing 40 and a downhole facing surface of inner mandrel 41.

Figure 30:
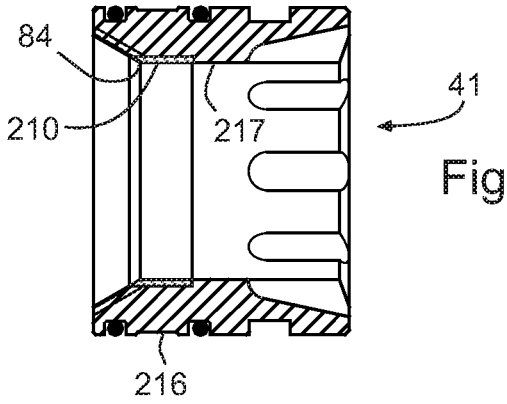
FIG. 30 is a section view of another embodiment of an inner mandrel from the embodiment of FIG. 29, with a steel liner forming the ball seating surface, and with a second embodiment for the shape of the liner shown in dashed lines.

Referring to FIG. 30, parts of inner mandrel 41 may be formed with an abrasion and contact resistant material 210. Such material 210, for example steel, may form part or all of the uphole facing drop plug seat surface 84 to fortify dissolvable material 216 in inner mandrel 41 from damage caused by both the initial contact with drop plug 10 and subsequent pressurization. Other suitably strong impregnable materials may be used, such as materials with a ksi of 50 and over. An abrasion resistant material may also protect the mandrel 41 from premature exposure of the dissolvable material 216 to fluids during the flow of proppant. Abrasion and contact resistant material 210 may be present as a liner positioned within interior passageway 46, for example a liner that encircles the passageway 46. Two examples are shown in FIG. 30, one where the material 210 lines only the seat surface (solid lines), and the second where the material 210 lines the seat surface and a nose portion, of the mandrel 41, that faces uphole into the path of proppant-laden fluid. In such a manner the material 210 may act as a wear sleeve. In some cases, an abrasion and contact resistant material 210 may be used such as a steel insert, and the parts of inner mandrel 41 exposed to fluid may have a protective coating such as a copper plate overlaid with a PTFE coating to make the copper plate impermeable.

Referring to FIGS. 31-32, dissolvable material 216 may be leveraged during a downhole treatment with downhole valve 54. Drop plug 10 may be pumped down a well 44 into an interior bore 83 of valve 54 to close the valve 54. The fluid may then be pressurized in the well to an extent sufficient to open a port 73 to an exterior of the downhole valve 54. Fluid may then be pumped through the port 73, with or without proppant, into the exterior of the downhole valve 54 at or above the fracturing pressure of the formation. Before, during, or after fracturing the formation, protective coating 217, if present, may be removed from the surface of the dissolvable material 216 by pumping an abrasive into contact with the coating 217. In some cases, the abrasive is pumped prior to pumping the drop plug 10 down the well. After the frac or other downhole treatment the tubing may be filled with brine or acid or both to dissolve all dissolvable components.

Referring to FIG. 3, in one case the rod part 14 is made of stronger material than the ring part. An alloy may be a mixture of two or more elements in which the main component is a metal. The well 44 may be lined with casing with or without perforations, or may be an open hole. Vertical, deviated, and horizontal wells may be treated using the downhole valves disclosed here. The compound seat may be made of ductile material to reduce pressure setting thresholds. The metal part of the plug may be made of suitable materials such as metallic material, aluminum, aluminum alloy, zinc alloy, magnesium alloy, steel, brass, aluminum bronze, metallic nanostructure material, and cast iron or others. In some cases the stronger of the two structural materials may be made of ceramic. The non-metallic or weaker part of the plug may be made of suitable materials such as plastic, composite material, thermoplastic, hollow materials and others.

Downhole components may be tubular in shape. Each end of a downhole valve may incorporate a tubing string connector, such as a pin or box threaded connector. Threaded connections, threading, and threads all refer to the same thing—a part that may be threaded to corresponding mating threads on a second component. Other components may be used that are not described, such as subs, sleeves, or other components, such as tubular spans of pipe between valves 54. Various seals, such as 101, 102, 199 and 201, may be provided between components, such as o-rings, packing, or other gaskets. Slips, wickers, plugs, shear-operated packer components, and other components may be used. The tubing string may comprise coiled or jointed tubing. All bores may be cylindrical, may have cylindrical and non-cylindrical parts, or may be non-cylindrical in nature, and may or may not be coaxial with the outer housing 40. The inner mandrel may be supplied as a modular cartridge that can be inserted into or otherwise connected to the outer housing, for example by threaded connection, and in some cases the inner mandrel may be in whole or in part integrally connected to the outer housing.

A rod part may have a cylindrical, cone or other tapered shape. A downhole drop plug may comprise a dart, ball (sphere), cone, cylinder, bar, or a wiper ball. Bypass grooves and restriction surfaces may be on a collar extended from the outer housing in a downhole direction from the inner mandrel. A coating may be present around the drop plug. The uphole facing actuator surface need not seal the ball, and may be other than a seat, for example a lever. The seats or other drop plug contacting surfaces on the sleeve part 86 may be located at intermediate locations between the uphole and downhole ends of the sleeve part 86.

Pumping may include dropping the plug down a vertical well. Various locks may be used to restrict axial movement between components, such as ratchets, collets, lock rings, split rings (including C-rings), and others. The methods and devices disclosed here may be used in other than fracturing applications, such as acidizing, disconnecting, tubing draining, and others. In some cases drop plugs may have a hole drilled offset from center to house the rod part. A restriction includes a relative minimum lateral diameter or width in an interior bore or passageway, and may define a flow area of close tolerance with the largest ball size capable of being passed through. Stem and receptacle parts may be other than cylindrical, for example such may have rectangular or polygonal cross-sections. Plural stem parts and corresponding receptacles may be present on a valve The sleeve part 86 may be provided in two or more modules to permit greater than two same sized balls to pass and seat the sleeve part 86. Interior bores or passageways may have the same shape, and a bore is not necessarily cylindrical and could have radial projections or be defined as a passageway. Words such as downhole, uphole, up, down, above, below, and others are intended to be relative and not restricted to orientations defined relative to the surface of the earth. Stop surfaces and corresponding surfaces that contact stop surfaces may be defined on shoulders, for example annular shoulders. Packers are disclosed but other wellbore isolation devices may be used to isolate zones. A pressure equalization port 146 may be provided between components. Symmetry may refer to symmetry in cross-section, exterior surface, or both. All the examples shown in the Figures and Tables are intended to be non-limiting. Features of each of the embodiments above may be combined with features of other of the embodiments. Pressure connections may be made by suitable mechanisms such as thread and glue, thread and o-ring, torque-rings, welding, soldering, and machining in place. Seat surfaces for plug 10 may have a suitable shape such as conical, curved, and multi-step. Dissolvable materials include polyglycolic acid (PGA) and other non-metals.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A downhole valve comprising:

an outer housing defining an interior bore;

an inner mandrel mounted in the interior bore, the inner mandrel defining an interior passageway between an uphole end and a downhole end of the inner mandrel, the inner mandrel defining an uphole facing drop plug seat surface encircling the interior passageway; and in which the inner mandrel comprises dissolvable material that is protected from wellbore fluids and fluids within the interior passageway; and in which the inner mandrel is actuatable by a drop plug to expose the dissolvable material to one or more of the wellbore fluids and the fluids within the interior passageway.

2. The downhole valve of claim 1 in which the inner mandrel comprises a protective coating covering the dissolvable material.

3. The downhole valve of claim 2 in which the protective coating is removable on exposure to contact with the drop plug or contact with an abrasive.

4. The downhole valve of claim 3 in which the uphole facing drop plug seat surface is formed with an abrasion and contact resistant material.

5. The downhole valve of claim 4 in which the abrasion and contact resistant material comprises steel.

6. The downhole valve of claim 4 in which the abrasion and contact resistant material is present as a liner positioned within the interior passageway.

7. The downhole valve of claim 2 in which:

the dissolvable material comprises a first metal that dissolves in the presence of an electrolyte; and the protective coating comprises a second metal that is in electrical contact with the dissolvable material, and that accelerates a rate of dissolution of the dissolvable material when the dissolvable material and protective coating are exposed to the electrolyte.

8. The downhole valve of claim 7 in which the protective coating is electroplated to the dissolvable material.

9. The downhole valve of claim 7 in which the protective coating comprises copper, nickel, or silver.

10. The downhole valve of claim 2 in which the protective coating comprises a non-metal.

11. The downhole valve of claim 10 which the non-metal comprises a polymeric material.

12. The downhole valve of claim 11 which the polymeric material comprises polytetrafluoroethylene.

13. The downhole valve of claim 1 in which the inner mandrel has a first position where the inner mandrel is actuatable by the drop plug to shift to a second position where the dissolvable material becomes exposed to one or more of wellbore fluids and fluids within the interior passageway.

14. The downhole valve of claim 13 in which:

in the first position, an outer wall surface portion of the inner mandrel is sealed within an inner restriction surface in the outer housing, and the dissolvable material is located on or in fluid communication with the outer wall surface portion; and upon actuation the outer wall surface portion slides out of contact with the restriction surface to expose the dissolvable material.

15. The downhole valve of claim 14 in which the dissolvable material is in fluid communication with the outer wall surface portion via a port in the inner mandrel to the outer wall surface portion.

16. The downhole valve of claim 13 in which the downhole valve is actuatable to open a port to an exterior surface of the outer housing.

* * * * *